US011404777B2

(12) United States Patent
Logothetis et al.

(10) Patent No.: US 11,404,777 B2
(45) Date of Patent: Aug. 2, 2022

(54) MOVEABLE ANTENNA APPARATUS

(71) Applicant: AIRSPAN IP HOLDCO LLC, Boca Raton, FL (US)

(72) Inventors: Andrew Logothetis, Buckinghamshire (GB); Marlon Peter Persaud, Buckinghamshire (GB); David Charles Brokenshire, Berkshire (GB)

(73) Assignee: AIRSPAN HOLDCO LLC, Boca Raton, FL (US)

( * ) Notice: Subject to any disclaimer, the term of this patent is extended or adjusted under 35 U.S.C. 154(b) by 383 days.

(21) Appl. No.: 16/444,192

(22) Filed: Jun. 18, 2019

(65) Prior Publication Data

US 2019/0393598 A1 Dec. 26, 2019

(30) Foreign Application Priority Data

Jun. 21, 2018 (GB) ..... 1810220

(51) Int. Cl.

| | |
|---|---|
| ***H01Q 3/08*** | (2006.01) |
| ***H01Q 1/12*** | (2006.01) |
| ***H01Q 1/24*** | (2006.01) |

(52) U.S. Cl.

CPC ..... *H01Q 3/08* (2013.01); *H01Q 1/125* (2013.01); *H01Q 1/24* (2013.01)

(58) Field of Classification Search

CPC ..... H01Q 3/08; H01Q 1/12; H01Q 1/24
USPC ..... 343/757
See application file for complete search history.

(56) References Cited

U.S. PATENT DOCUMENTS

| | | | |
|---|---|---|---|
| 5,210,542 | A | 5/1993 | Pett et al. |
| 6,034,643 | A | 3/2000 | Nishikawa et al. |
| 9,647,748 | B1 | 5/2017 | Mitchell |
| 2001/0046258 | A1 | 11/2001 | Wise et al. |
| 2002/0167449 | A1 | 11/2002 | Frazita et al. |
| 2004/0246174 | A1 | 12/2004 | Lamour et al. |
| 2005/0146473 | A1 | 7/2005 | Stoyanov et al. |

(Continued)

FOREIGN PATENT DOCUMENTS

| | | | |
|---|---|---|---|
| GB | 1271346 | A | 4/1972 |
| GB | 2196482 | A | 4/1988 |

(Continued)

OTHER PUBLICATIONS

UK Search Report from 1810220.2 dated Dec. 4, 2018, 5 pages.

(Continued)

*Primary Examiner* — Andrea Lindgren Baltzell
(74) *Attorney, Agent, or Firm* — Haynes Beffel & Wolfeld LLP; Andrew Dunlap; Franklin M. Schellenberg

(57) ABSTRACT

An antenna apparatus comprising at least one antenna array configured to produce a beam to facilitate wireless communication with at least one other antenna apparatus is described, in which the beam can be electronically steered in an associated beamforming plane by beamforming circuitry. The at least one antenna array has an associated antenna array plane, and an antenna array rotation mechanism is configured to rotate each antenna array in its associated antenna array plane to cause its beamforming plane to rotate. Methods for operating such an antenna apparatus, and for deploying an antenna apparatus in a wireless communication network, are also described.

18 Claims, 16 Drawing Sheets

(56) References Cited

U.S. PATENT DOCUMENTS

| | | | | |
|---|---|---|---|---|
| 2006/0071867 | A1* | 4/2006 | Quagliaro | H01Q 3/08 343/705 |
| 2006/0114164 | A1 | 6/2006 | Iluz et al. | |
| 2006/0139224 | A1 | 6/2006 | Tietjen | |
| 2006/0176843 | A1* | 8/2006 | Gat | H04B 7/18523 370/316 |
| 2007/0013593 | A1 | 1/2007 | Zafar et al. | |
| 2009/0267835 | A1* | 10/2009 | Tietjen | H01Q 1/084 342/368 |
| 2010/0052994 | A1* | 3/2010 | Llorens del Rio | H01Q 21/0087 343/700 MS |

FOREIGN PATENT DOCUMENTS

| | | | |
|---|---|---|---|
| JP | H05152824 | A | 6/1993 |
| JP | H0878936 | A | 3/1996 |

OTHER PUBLICATIONS

PCT Search Report and Written Opinion from PCT/GB2019/051418 dated Aug. 2, 2019, 16 pages.
GB Examination Report from 1810220.2 dated Jan. 28, 2022, 6 pages.

* cited by examiner

MOVEABLE ANTENNA APPARATUS

The present technique relates to the field of wireless communications.

In modern wireless communications systems, there is a move towards using higher frequency signals, with the aim of increasing the bandwidth. However, path loss issues become more significant as higher frequencies are used, and accordingly there is a tendency to use narrow beams in order to deliver coverage to the edge of the cells within the wireless communications system. However, an issue that then arises is how to direct beams in an appropriate manner, so as to enable communication with items of user equipment within the cells.

Some antenna arrays can direct a radio frequency (RF) signal towards a target by electronically steering the beam. Many communications networks rely on antenna apparatuses in the network being deployed at approximately the same elevation, so that only beam steering in the horizontal or azimuth plane is required. However, in densely populated urban environments, where users of a communications network may require antenna apparatuses to be deployed at various elevations (for example, due to living in tall buildings), beam steering in only the horizontal plane is not sufficient. However, electronically steering a beam in three dimensions requires complex hardware, and is not always cost-effective.

Viewed from a first aspect, the present technique provides an antenna apparatus, comprising: at least one antenna array, each antenna array having an associated antenna array plane and configured to produce a beam to facilitate wireless communication with at least one other antenna apparatus; beamforming circuitry configured, for each antenna array, to electronically steer the beam in an associated beamforming plane; and an antenna array rotation mechanism configured to rotate each antenna array in its antenna array plane so as to cause the associated beamforming plane to rotate.

Viewed from a second aspect, the present technique provides a method of operating an antenna apparatus comprising at least one antenna array, each antenna array having an associated antenna array plane and configured to produce a beam to facilitate wireless communication with at least one other antenna apparatus, the method comprising: for each antenna array, electronically steering the beam in an associated beamforming plane; and rotating each antenna array in its antenna array plane so as to cause the associated beamforming plane to rotate.

Viewed from a further aspect, the present technique provides a method of deploying an antenna apparatus within a wireless communication network, comprising: fixing the antenna apparatus to a deployment structure, the antenna apparatus having at least one antenna array, each antenna array having an associated antenna array plane and configured to produce a beam to facilitate wireless communication with at least one other antenna apparatus in the wireless communication network; and operating the antenna apparatus according to the method of the above-mentioned second aspect so as, for each antenna array, to rotate the beamforming plane and electronically steer the beam within the beamforming plane taking into account the at least one other antenna apparatus in the wireless communication network that the antenna apparatus is to communicate with.

Viewed from a yet further aspect, the present technique provides an antenna apparatus, comprising: at least one antenna array means for producing a beam to facilitate wireless communication with at least one other antenna apparatus, each antenna array means having an associated antenna array plane; beamforming means for electronically steering, for each antenna array means, the beam in an associated beamforming plane; and rotation means for rotating each antenna array means in its antenna array plane so as to cause the associated beamforming plane to rotate.

Further aspects, features and advantages of the present technique will be apparent from the following description of examples, which is to be read in conjunction with the accompanying drawings, in which.

Figure 1:
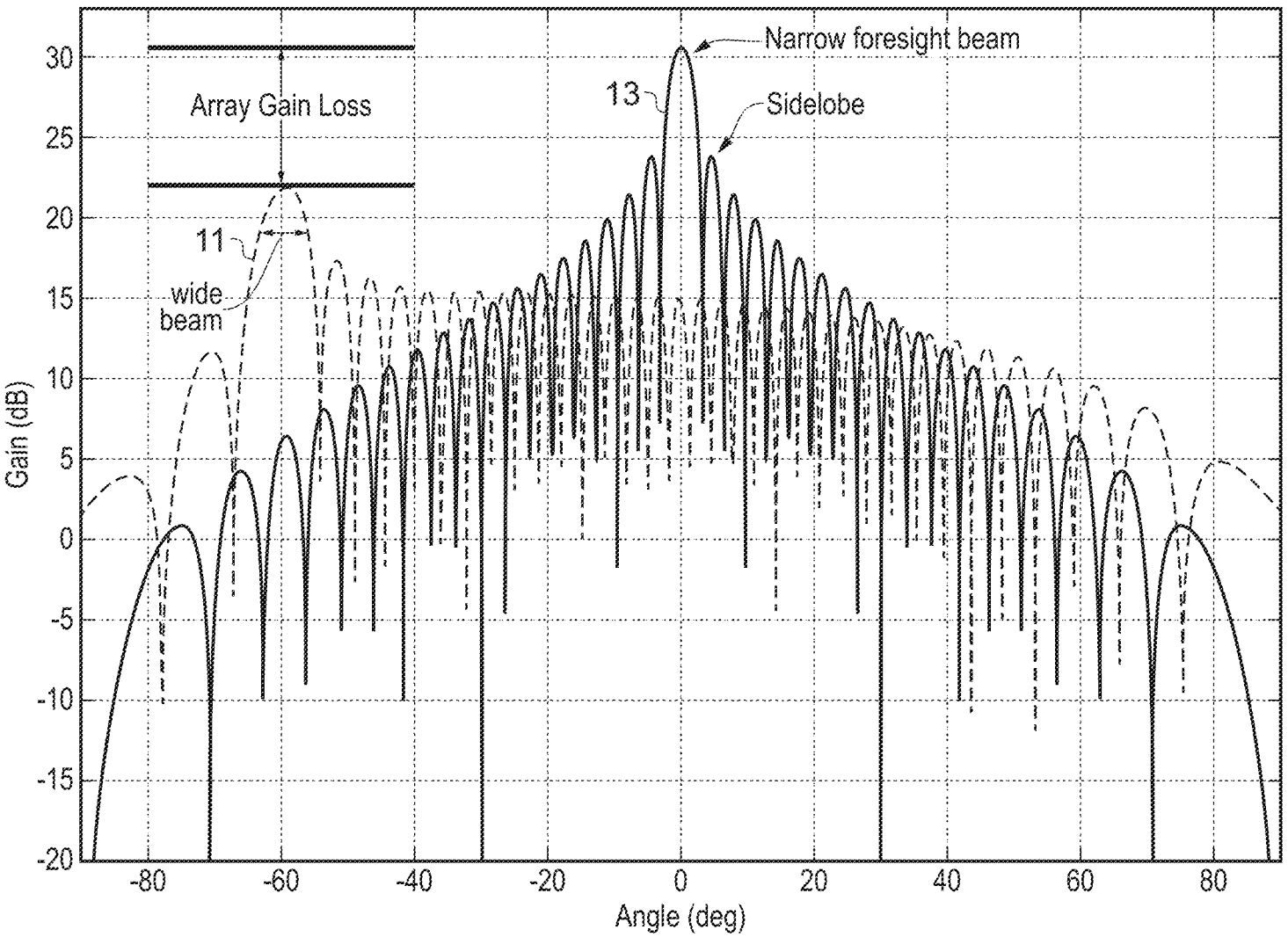
FIG. 1 is a graph of the gain of a beam of an antenna apparatus when electronically steered to various angles.

Before discussing the embodiments with reference to the accompanying figures, the following description of example configurations and associated advantages is provided.

In accordance with one example configuration there is provided an antenna apparatus comprising at least one antenna array, each antenna array having an associated antenna array plane and configured to produce a beam to facilitate wireless communication with at least one other antenna apparatus. The antenna apparatus of this example also includes beamforming circuitry to electronically steer the beam of each antenna array in its associated beamforming plane, and an antenna array rotation mechanism configured to rotate each antenna array in its antenna array plane, so as to cause the beamforming plane to rotate.

By combining beamforming circuitry to electronically steer each antenna array in one plane (the beamforming plane), and an antenna array rotation mechanism to cause the beamforming plane to rotate, the beam produced by each antenna array can be steered in three dimensions, using significantly less hardware than would be required to steer the beam in three dimensions entirely through electronic beam steering.

The antenna array plane is a plane defined by the antenna array itself. For example, if the antenna array is substantially flat, the antenna array plane may be parallel to the antenna array itself. The beamforming plane is the plane in which the beam is configured to be electronically steered, enabling the predominant direction of the beam to be steered left or right within the beamforming plane. The beam will also have a form within an elevation plane, which extends at right angles to the beamforming plane. Whilst the electronic beam steering may be constrained to take place within the beamforming plane, allowing a narrow beam to be directed as desired within the beamforming plane, in one example implementation the profile of the beam may be arranged to be relatively wide within the elevation plane and not be subjected to active beam steering.

The direction in which the beam can be steered may be defined by the specific arrangement of the antenna elements in the antenna array, so rotation of the antenna array by the antenna array rotation mechanism also causes the beamforming plane to rotate, allowing the beam to be steered in three dimensions by a combination of electronic beam steering and mechanical rotation of array itself. The at least one antenna array can, for example, be a uniform linear array (ULA) comprising a number of antenna elements, although any other form of antenna array may be used.

Each antenna array may include transmit antenna elements and/or receive antenna elements, and indeed may be used for both transmission and reception, and accordingly the beam generated can be used as a transmit beam and/or a receive beam, in the latter case the receive beam identifying the coverage area where the antenna array is most sensitive to transmitted signals from other items of antenna equipment.

In some examples, each antenna array is arranged such that its associated beamforming plane is perpendicular to the antenna array plane. The orientation of the beamforming plane is determined by the specific arrangement of the antenna elements in the antenna array.

In some examples, the antenna apparatus includes multiple antenna arrays, each of which can rotate under the control of the antenna array rotation mechanism.

There are many possible reasons for including more than one antenna array. For example, when using multiple arrays, those arrays can be steered in different directions, increasing the coverage they provide. This may also allow them to cooperate to act in point-to-point, point-to-multipoint or relay mode within a communication network. Another example may involve directing the multiple antenna arrays towards the same direction, in order to double the bandwidth of communications sent to or received by the antenna apparatus.

In some examples, the multiple antenna arrays can be rotated independently of each other.

This allows the antenna arrays to be steered in different directions, allowing them to operate in any of a variety of modes including point-to-point mode, point-to-multipoint mode or relay mode. In some examples, this also allows the antenna arrays to be rotated so that their beams do not interfere with each other.

In some examples, the antenna apparatus also includes antenna array control circuitry to coordinate operation of the plurality of antenna arrays dependent on their rotation. By coordinating operation of the antenna arrays, the antenna array control circuitry can allow the antenna apparatus to operate in any of the modes discussed above.

In some examples, where the antenna apparatus includes multiple antenna arrays, it also includes a mounting plate to support the antenna arrays, and a mounting plate rotation mechanism to rotate the mounting plate about a first axis.

In these examples, the mounting plate rotation mechanism rotates all of the antenna arrays together. This provides further freedom, allowing the antenna apparatus to be operated in a wider variety of modes. For example, in one orientation, the antenna apparatus may be able to facilitate communication with multiple antenna apparatuses across a wide range of azimuth directions, but at approximately the same elevation, while rotating the mounting plate 90° from a horizontal orientation to a vertical orientation can allow the antenna apparatus to communicate with multiple antenna apparatuses at different elevations, but a narrower range of azimuth directions.

In some examples, the antenna apparatus includes a further rotation mechanism to rotate the plurality of antenna arrays about a second axis, where the second axis is perpendicular to the first axis.

This provides even more freedom, allowing the antenna array to be steered to be directed towards any target in any direction.

In some examples, the beam produced by each antenna array has an associated polarisation plane, and the rotation of each antenna array also causes the associated polarization plane to rotate.

The polarization direction of the beam is the direction—perpendicular to the direction of propagation of the beam itself—in which the beam is polarized (e.g. the direction in which the electromagnetic field of the beam oscillates). The polarization plane is therefore the plane in which the beam is polarized. In order for a receiver to receive a signal, the polarization of the beam of the signal must be less than 90° from the polarization of the receiver, and ideally the two should be as close as possible. Hence, by rotating each antenna array to rotate its polarization plane, the polarization can be adjusted to match the polarization of the beam to the desired receiver (the antenna array being rotated may be the transmitter producing a transmitted beam with a particular polarization, or a receiver where the rotation can align the polarization of the receiver with the beam being received from another antenna apparatus).

In some examples, the antenna apparatus includes at least two antenna arrays, and the antenna array rotation mechanism is arranged to rotate the two antenna arrays such that their polarization planes are perpendicular to one another.

By ensuring that the polarization planes of the antenna arrays are perpendicular, interference between the beams of the two arrays can be mitigated. This polarization discrimination facilitates the reception of two independent signals by the two arrays with no or negligible co-channel interference.

In some examples, each antenna array consists of a plurality of antenna elements arranged into interconnected groups, each group being associated with a single receive/transmit unit.

In this configuration, a single transceiver (receive/transmit unit) provides a current feed into a group of elements. The direction of the beamforming plane is then constrained by the arrangement of the groups, however the advantage provided by this arrangement is a significant reduction in the hardware needed to implement the design. Rather than providing a single transceiver for each element, which would require significant extra hardware and would take up a large amount of space in the antenna apparatus, this solution provides a compact, efficient antenna array design.

In some examples, the plurality of antenna elements are arranged in a grid formation in the antenna array plane, and the groups of interconnected antenna elements are arranged as parallel lines of antenna elements. This provides an efficient and compact arrangement of antenna elements, with minimal hardware cost.

In some examples, the beamforming plane is perpendicular to the lines of interconnected antenna elements.

In these examples, the beamforming plane is restricted to be perpendicular to the direction of the parallel lines of antenna elements, however the provision of the antenna array rotation mechanism allows the beamforming plane to be rotated, so providing a great deal of flexibility in how the antenna apparatus is used in any particular deployment situation. Hence, the design of the antenna array can be made compact and efficient, with minimal hardware cost and without sacrificing the level of coverage provided by the beam.

In some examples, the antenna array rotation mechanism includes a rotation mechanism for each array. This allows the antenna arrays to be rotated individually, such that they can be independently steered.

In some examples, each antenna array is mounted on an associated support, and the rotation mechanism for each array includes a motor configured to drive rotation of the support on which each antenna array is mounted.

In some examples, the antenna array rotation mechanism is configured to be operated remotely. By arranging the antenna apparatus such that the antenna array rotation mechanism can be operated remotely, the direction of the beam can be altered from some distance away from the apparatus itself. This may be particularly useful if the beam needs to be adjusted following changes in a communication network in which the antenna apparatus is deployed, particularly if the antenna apparatus is in a hard-to-reach area, such as on a tall building, on a lamppost, or in a customer's home.

In some examples, the antenna apparatus includes antenna array rotation selection circuitry, configured to select a chosen rotation for each array, for example from a chosen set of predetermined rotations.

The antenna array rotation selection circuitry may select a chosen rotation on the basis of a control signal from an operator controlling the antenna array rotation mechanism remotely, or it may select the chosen rotation on the basis of information indicating the location of other antenna apparatuses. This allows the antenna apparatus to be adjusted automatically, which is particularly useful if the communication network in which the antenna apparatus is used is adjusted frequently, or if the antenna apparatus is in a hard-to-reach location.

In some examples, the antenna apparatus includes a first antenna array and a second antenna array, and antenna positioning circuitry configured to move the first antenna array relative to the second antenna array about a common axis of rotation to facilitate positioning of the first and second antenna arrays in a chosen deployment configuration between a first limit and a second limit.

By providing antenna positioning circuitry to move a first antenna array relative to a second antenna array, the antenna apparatus can be mechanically steered to change the boresight direction (the direction of maximum gain) of one or both antenna arrays. This allows the antenna apparatus to be directed towards a target location without the beam broadening and gain loss associated with purely electronically steering an antenna apparatus. This arrangement allows a broad area to be covered by a single antenna apparatus by providing at least two antenna arrays configured to coordinate their operation, and moveable with respect to one another. This also allows the mode of operation of the antenna apparatus to be varied effectively, based on the chosen deployment configuration.

In some examples, at the first limit, the first and second antenna arrays are positioned adjacent to each other to face in the same direction, while at the second limit, the first and second antenna arrays are positioned back-to-back to face in opposing directions.

By setting the first and second limits to be in adjacent and back-to-back arrangements respectively, a wide range of areas can be covered by a single antenna apparatus, and a variety of different deployment configurations can be accommodated. At the first limit, the antenna arrays may be coplanar, such that their boresight directions are in substantially the same direction, although the boresight directions are not necessarily in exactly the same direction. In the first limit, the angle between the antenna arrays is 180° or close to 180° (for example it could be within ±10° of 180°, or it could be further from 180°, depending on the requirements and capabilities of the system). At the second limit, the antenna arrays may be parallel to one another but facing in opposing directions, such that their boresight directions are in substantially opposite directions, although the boresight directions need not necessarily be in exactly opposing directions. In the second limit, the angle between the first and second antenna arrays is 0° or close to 0° (for example it could be within ±10° of 0°, or it could be further from 0°, depending on the requirements and capabilities of the system)—this angle could also be referred to as 360° or close to 360°. The exact angles of the first and second limits need not be limited to 180° and 0° respectively, but may be determined in dependence on the requirements of the system.

In some examples, the antenna apparatus is operable in a chosen mode which is one of a relay mode, a point-to-point mode, a point-to-multipoint mode and any combination thereof, and the chosen deployment configuration is chosen in dependence on the chosen mode.

In this way, a variety of modes of operation are possible for a single antenna apparatus, improving the utility and versatility of the apparatus. Relay mode involves, in some examples, receiving a transmission and then transmitting the same transmission to some target, point-to-point mode involves a transmission sent from a single location to a different single location, and point-to-multipoint mode involves sending a transmission from a single point to a plurality of targets. The antenna apparatus may be operated in any of these modes or in any combination of these modes. For example, the antenna may be configured such that one antenna array is used in a relay configuration to relay backhaul data in one direction, whilst the other antenna array is used in a point-to-multipoint configuration to offload data traffic to a number of users in another direction. The deployment configuration may be selected in dependence on the mode in which the antenna apparatus is operating.

In some examples the first and second antenna arrays are configured to operate using the same frequency channel or different frequency channels.

Hence, there is a greater degree of freedom as to how the individual antenna arrays are used in a cooperative manner.

In some examples, a method of operating an antenna apparatus according to any of the examples above is provided. The method includes electronically steering the beam of each antenna array in an associated beamforming plane, and rotating each antenna array in its antenna array plane so as to cause the associated beamforming plane to rotate.

In some examples, a method of deploying an antenna apparatus in a communication network including at least one other antenna apparatus is provided, the antenna apparatuses being arranged according to any of the examples above. In the method, the antenna apparatus is fixed to a deployment structure, and the antenna apparatus is operated according to the method described above so as, for each antenna array, to rotate the beamforming plane and electronically steer the beam within the beamforming plane, taking into account the at least one other antenna apparatus in the wireless communication network that the antenna apparatus is to communicate with.

Particular embodiments will now be described with reference to the figures.

FIGS. 1 to 9 describe a form of antenna apparatus where a first antenna array can be moved relative to a second antenna array about a common axis of rotation. The technique described herein, whereby individual antenna arrays can be rotated within their antenna array plane, can be used in association with a variety of different forms of antenna apparatus, but in one particular example the technique is deployed in association with an antenna apparatus such as described in FIGS. 1 to 9, as will be discussed in more detail later with reference to FIGS. 12 to 17.

FIG. 1 is a graph of the gain of the beam produced by an antenna apparatus against the angle between the direction of the beam and the boresight direction, where the boresight direction is the direction of maximum gain for the antenna or antenna array. As shown in the figure, a beam 13 aligned to point in its boresight direction (e.g. an angle of 0° from boresight) may have a narrow boresight beam (shown as the central peak in the graph) with high gain. In contrast, a beam electronically steered away from the boresight direction has a reduced gain and increased beam width. For example, in FIG. 1, the beam 11 electronically steered 60° away from the boresight direction has a beam width approximately twice that of the beam 13 at boresight, with a gain around 9 dB lower. For completeness, the side lobes for both beams are shown within FIG. 1, but are not of relevance to the present discussion.

In modern communications systems using high frequencies, narrow beams are used to seek to deliver coverage to the edge of the cell. However, as is apparent from FIG. 1, as the narrow beam is electronically steered in order to seek to cover areas of the cell away from the boresight direction, there are significant attenuation losses which can make it difficult to maintain coverage, particularly at the edges of the cell associated with the antenna apparatus. Whilst at the time of initial deployment of the antenna apparatus, it may be possible to select the predominant direction of the antenna array (and hence its boresight direction) through the mechanical positioning of the apparatus, it is often the case that electronic beam steering is then used to tune the direction of the beam in use. However, as is evident by FIG. 1, coverage issues can arise when narrow beams are used. The techniques described herein aim to alleviate these issues, by providing a mechanism by which an antenna apparatus is provided with first and second antenna arrays which can have their orientation with respect to each other mechanically adjusted during use. This provides a great deal of flexibility in the provision of suitable beam coverage within a cell in which the antenna apparatus is deployed, and enables a number of different modes of operation of the antenna apparatus to be readily supported.

Figure 2:
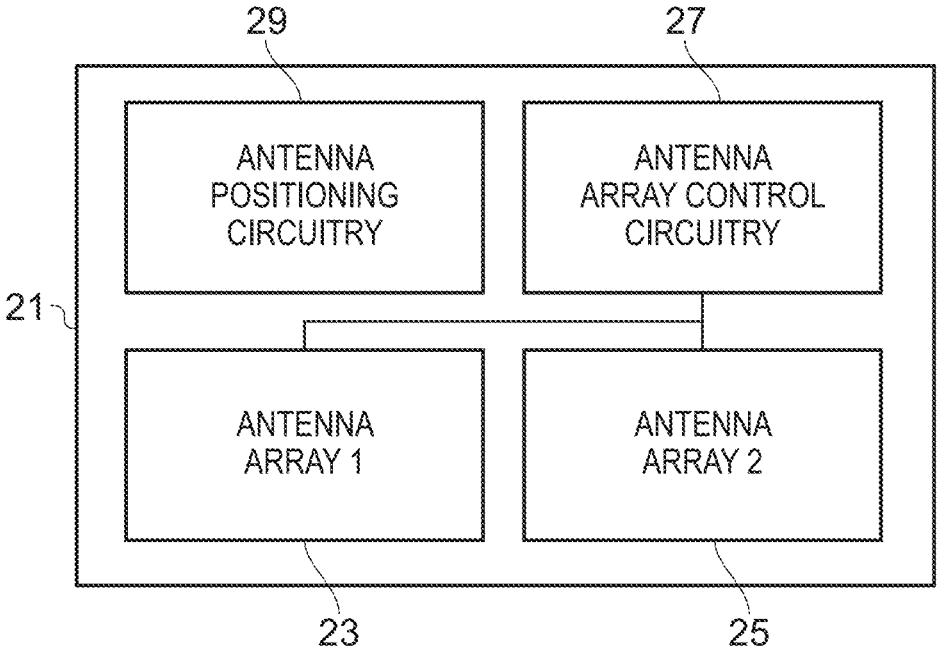
FIG. 2 is a block diagram of an example antenna apparatus.

FIG. 2 shows a block diagram of an antenna apparatus 21 according to a first example configuration of the present technique. FIG. 2 shows two antenna arrays 23, 25, antenna array control circuitry 27 and antenna positioning circuitry 29. The antenna arrays 23, 25 are configured to be moveable relative to one another about a common axis of rotation. The antenna positioning circuitry 29 is configured to control the motion of the antenna arrays 23, 25 relative to one another. The antenna arrays 23, 25 are configured to work in a coordinated manner, in dependence on their deployment configuration, and the antenna array control circuitry 27 is configured to control the antenna arrays and coordinate their operations. Although FIG. 2 only shows two antenna arrays, it will be appreciated that additional antenna arrays may also be provided.

Figure 3:
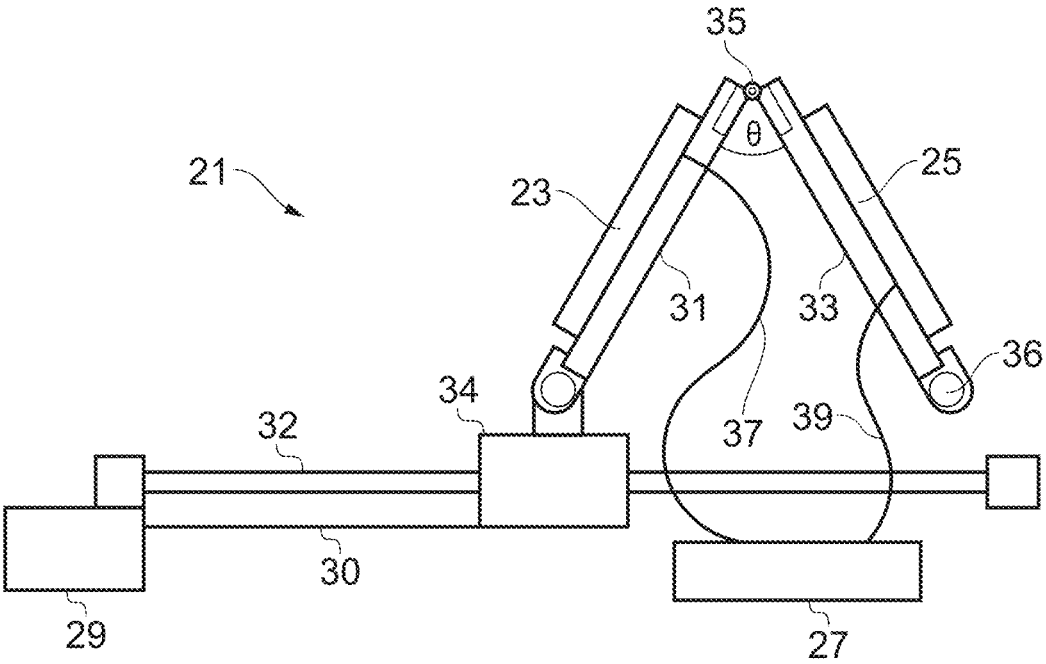
FIGS. 3 to 5 show an example antenna apparatus, in different deployment configurations.

FIG. 3 shows a schematic of an antenna apparatus 21 according to an example configuration of the present technique. In FIG. 3, the two antenna arrays 23 and 25 are each mounted on a support 31, 33. The supports 31, 33 are attached by a hinge 35 which, in the figure, is depicted as a butt hinge, however any other type of hinge may be used in place of a butt hinge. The hinge 35 allows the motion of one antenna array 23, 25 relative to the other, and defines the common axis of rotation about which the antenna arrays 23, 25 are configured to move. The hinge 35 allows the supports 31, 33 to be moved such as to vary the angle θ between them, where the angle θ also defines the angle between the antenna arrays 23, 25. The antenna apparatus 21 of FIG. 3 also includes antenna array control circuitry 27 coupled to the antenna arrays 23, 25 by flexible wires 37, 39. The antenna array control circuitry 27 is configured to control the coordinated operation of the antenna arrays 23, 25, by appropriate control of aspects such as the beam pattern used by each antenna array, the frequency channel used by each antenna array, the type of communications facilitated by each antenna array (relay, point-to-point, point to multipoint, etc.). The antenna array control circuitry 27 may also be used to electronically steer the beams of the two antenna arrays 23, 25 if desired.

One end of one of the supports 31 is coupled to a linear structure 32 by an attachment member 34. In this example, the attachment member 34 is configured to be slideable along the linear structure 32, which in this case may be a linear track, allowing the end of the support 31 to be linearly translated along the linear support, such as to vary the angle θ between the antenna arrays 23, 25. The antenna apparatus 21 also includes antenna positioning circuitry 29 which includes a motor (not shown separately) configured to move the attachment member 34 along the linear structure 32. The motor in the antenna positioning circuitry 29 is coupled to the attachment member 34 by a drive mechanism 30, which can be any suitable means that enables the motor to drive the attachment member 34, and is merely shown schematically in the figures by the element 30. The antenna positioning circuitry 21 includes electronics configured to control the relative motion of the antenna arrays 23, 25. The motor does not necessarily need to be integrally formed with the antenna positioning circuitry as in FIG. 3, but can instead be separate. Further, the antenna positioning circuitry can be provided at any suitable location within the apparatus, but in FIG. 3 is shown as being attached to, or integral with, one of the end stops of the linear structure 32. However, it can be useful for the motor position to be static so as to reduce the complexity of moving parts and the amount of flexible cabling.

One end of the other support 33 is fixed relative to the linear structure 32 at an anchor point 36. As a result of this, motion of the end of the first support 31 along the linear structure 32 increases or decreases the angle θ between the antenna arrays 23, 25 between a first limit and a second limit, such that a particular deployment configuration (a particular angle θ) can be selected from between the first and second limits.

Figure 4:
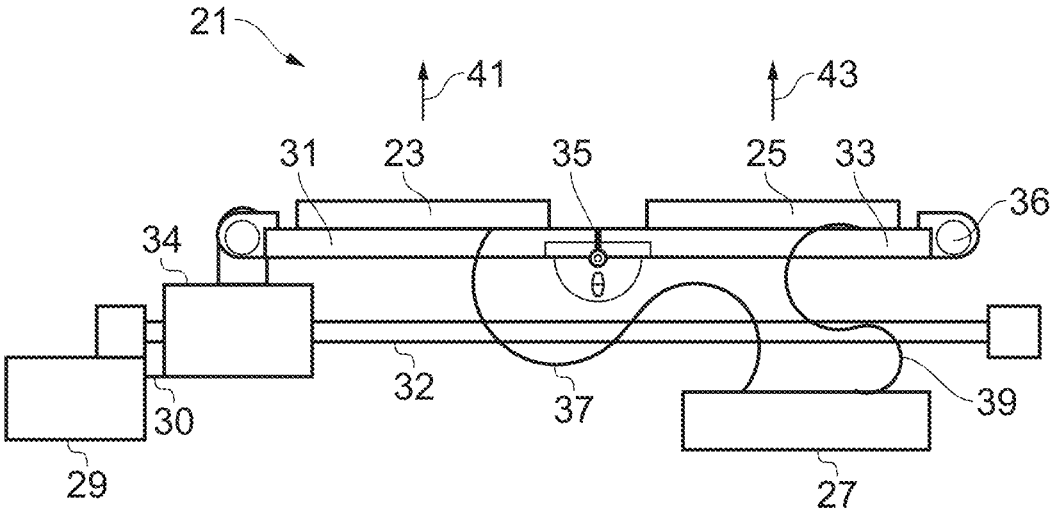

FIG. 4 shows a schematic of the antenna apparatus 21 in a particular deployment configuration according to an example configuration of the present technique. In FIG. 4, the antenna arrays 23, 25 are arranged adjacent to one another so that they face the same direction (e.g. their boresight directions are aligned, shown by arrows 41 and 43 in the figure). In this example, the angle θ between the supports 31, 33 is 180°. The attachment member 34 has been linearly translated along the linear structure 32 away from the fixed anchor point 36, causing the ends of the supports 31, 33 which are not coupled by the hinge 35 to be moved apart, such that the hinge 35 extends towards an open position. In some examples, this arrangement may be one of the limits between which the antenna arrays 23, 25 can be moved, although in other examples the first limit may be a different configuration, for example the angle θ in the first limit may be more or less than 180°, depending on the requirements of the system.

In this side-by-side configuration, the antenna arrays 23, 25 can be directed towards the same target. The area covered by the antenna apparatus 21 in this configuration can be configured to be narrow, with higher gain than in other configurations, since if both antenna arrays 23, 25 are arranged to operate in the same frequency channel, devices in the area can receive a transmission from both antenna arrays 23, 25 at once, potentially doubling throughput. However, other modes of operation are also possible; for example the two antenna arrays 23, 25 may be electronically steered to point in different directions, in order to increase the area of the region covered by the antenna apparatus 21 in this configuration. Alternatively, the antenna arrays 23, 25 may each operate in a different frequency channel, allowing them to service different areas or different devices in the same area without interfering with each other.

Figure 5:
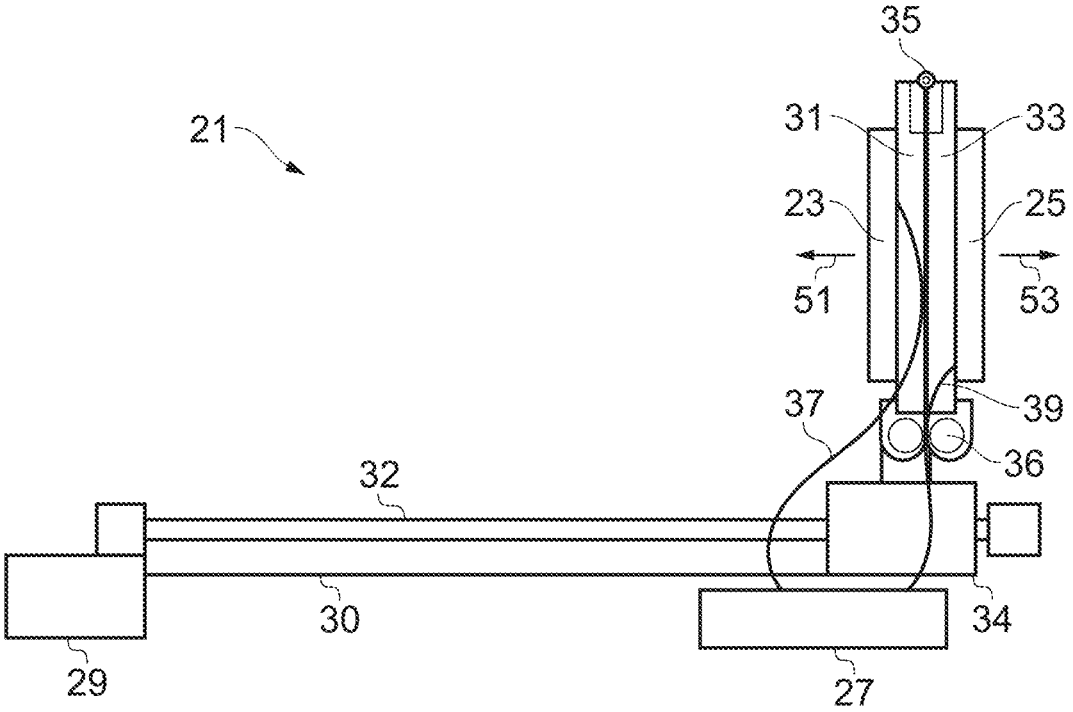

FIG. 5 shows a schematic of the antenna apparatus 21 in a different deployment configuration according to an example configuration of the present technique. In FIG. 5, the antenna arrays 23, 25 are arranged back-to-back so that they face in opposite directions (e.g. their boresight directions 51, 53 are in opposing directions). In this example, the angle θ between the supports 31, 33 is 0° (or 360°). The attachment member 34 has been linearly translated along the linear structure 32 towards the fixed anchor point 36, causing the ends of the supports 31, 33 which are not coupled by the hinge 35 to be moved together, such that the hinge 35 rotates towards a closed position. In some examples, this arrangement may be one of the limits between which the antenna arrays 23, 25 can be moved, although in other examples the second limit may be a different configuration, for example the angle θ in the second limit may be more than 0°, depending on the requirements of the system.

In this back-to-back configuration, the antenna arrays 23, 25 can be directed towards different targets. The area covered by the antenna apparatus 21 in this configuration has two lobes—that is, the area comprises two parts, one covered by each antenna array 23, 25. In this configuration, the antenna apparatus 21 may act in relay mode, for example In relay mode, one of the antenna arrays 23, 25 acts as a receiver and receives a transmission, while the other acts as a transmitter transmitting the received transmission to a further antenna apparatus. However, alternatively, the antenna arrays can each be arranged as transmitters or receivers having different coverage areas within the cell. When they are both arranged as transmitters, the transmission may be carried out in point-to-point mode, in which the antenna array 23, 25 transmits to a single receiver, or in point-to-multipoint mode, in which the antenna array 23, 25 transmits to a plurality of receivers. The antenna arrays 23, 25 may be configured to operate on the same frequency channel or on different frequency channels.

Figure 6:
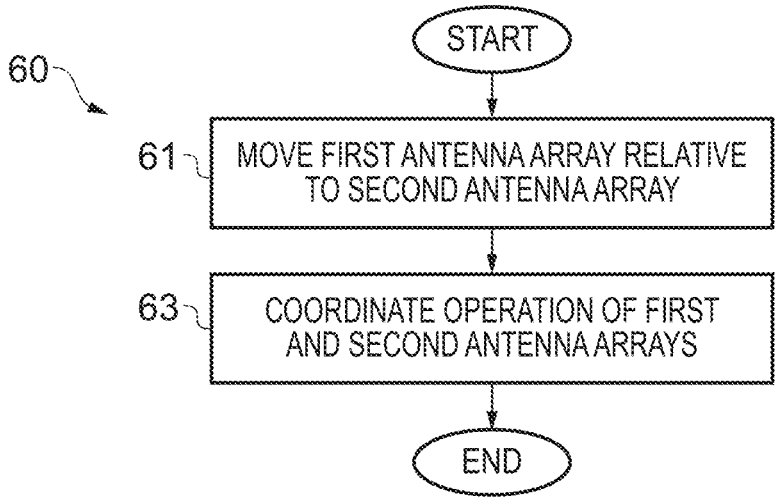
FIG. 6 is a flow diagram of a method of operating an antenna apparatus such as shown in FIGS. 2 to 5.

FIG. 6 is a flow diagram showing a method 60 of operating an antenna apparatus according to the present technique. The antenna apparatus comprises at least two antenna arrays and, in step 61, the first antenna array is moved relative to the second antenna array. These could be the antenna arrays 23, 25 of FIGS. 2 to 5, and the step 61 of moving one relative to the other involves moving the first antenna array relative to the second antenna array about a common axis of rotation, where the common axis of rotation is, in some examples, defined by a hinge apparatus 35. The first antenna array is moved 61 relative to the second antenna array to position the antenna apparatus in a deployment configuration chosen from a plurality of possible deployment configurations between a first limit and a second limit. The antenna arrays may be moved 61 relative to each other according to any of the techniques described above in relation to FIGS. 2-5. In step 63, operation of the first and second antenna arrays is coordinated by the antenna array control circuitry 27. This allows the antenna arrays to receive and/or transmit signals in coordination, according to the chosen deployment configuration. The antenna arrays can operate in any of a variety of modes, including relay mode, point-to-point mode, point-to-multipoint mode or any combination of the previous three modes.

Figure 7:
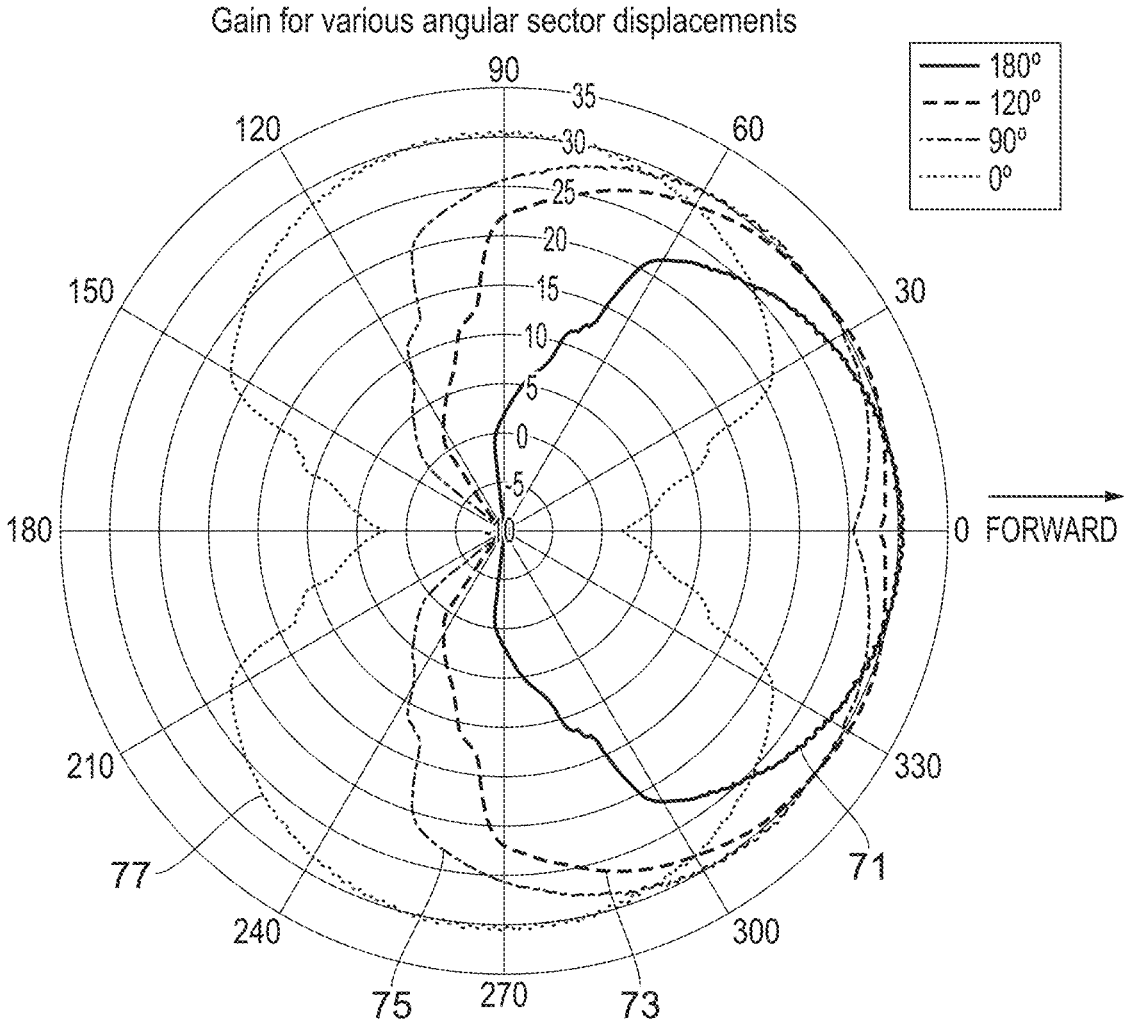
FIG. 7 is a graph of gain versus beam direction for an antenna apparatus in various configurations when using the antenna apparatus of FIGS. 2 to 5.

FIG. 7 is graph showing the areas covered by an antenna apparatus 21 according to the present technique in a number of deployment configurations. In one deployment configuration 71, in which the first and second antenna arrays 23, 25 are positioned adjacent to one another (e.g. when θ=180° as shown in FIG. 4) such that their boresight directions are aligned, the area covered by the apparatus is shown as fairly narrow. This configuration 71 allows both antenna arrays 23, 25 to be directed towards the same target. As FIG. 7 shows, decreasing the angle θ increases the size of the area covered by the antenna apparatus 21, but sacrifices gain in the forward direction. In particular in the deployment configuration 73, at θ=120°, the area covered by the antenna apparatus 21 is broader than the configuration 71 at θ=180°, but the gain in the forward direction is slightly reduced. Similarly, in the deployment configuration 75, at θ=90°, the area covered by the antenna apparatus 21 is even broader than at θ=120°, but the gain in the forward direction is even less. The final configuration 77 shown in FIG. 7 is θ=0°, where the first and second antenna arrays 23, 25 are positioned back-to-back, so that they have their boresight directions in opposing directions. In this configuration 77, the gain in the forward direction is significantly lower than in the other configurations, but the gain in the two sideways directions is much higher. This configuration 77 may be particularly useful in relay mode, where one of the two antenna arrays 23, 25 receives a signal from one direction and the other transmits the same signal in an opposing direction.

As FIG. 7 demonstrates, the arrangement of the antenna apparatus 21 according to the present technique provides significant flexibility, and allows the apparatus 21 to be arranged in a wide variety of deployment configurations, which can be tailored to the needs of the system. Although FIG. 7 only shows the coverage for 4 deployment configurations, it will be appreciated that a deployment with any angle θ can be chosen.

Figure 8:
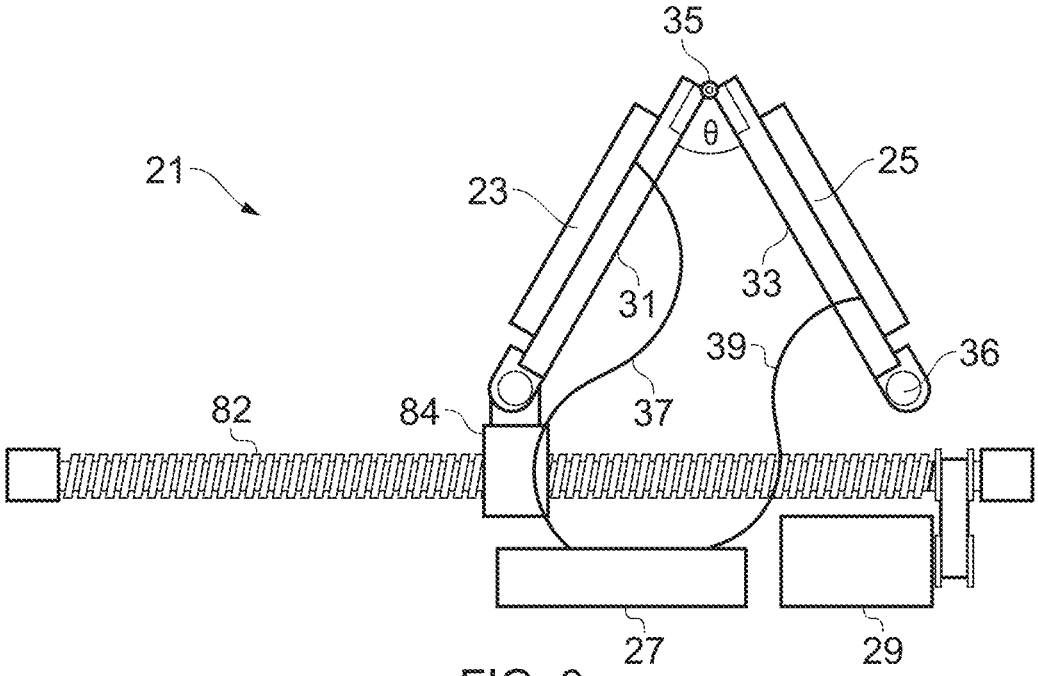
FIG. 8 is a schematic of another example antenna apparatus.

FIG. 8 shows a schematic of an embodiment of the antenna apparatus 21 according to the present technique, in which one of the supports 31 is mounted to a threaded linear structure 82 with a threaded attachment member 84. The attachment member 84 and linear structure 82 have complementary threading. In this configuration, the antenna positioning circuitry 29 is configured to control a motor to cause the linear structure 82 to rotate. In FIG. 8, as in FIGS. 3-5, the motor is within the antenna positioning circuitry 29, however in some examples the motor is separate from the antenna positioning circuitry. Due to the complementary threading on the linear structure 82 and the attachment member 84, the rotation of the linear structure 82 causes the attachment member to move along the linear structure towards or away from the anchor point 36. In this way, the angle θ can be decreased or increased in order to vary the deployment configuration of the antenna apparatus 21.

In some configurations, the antenna positioning circuitry 29 can be configured to drive the motor to cause the attachment member 84 to rotate instead of the linear structure 82, which similarly causes the attachment member 84 to move along the linear structure 82 towards or away from the anchor point 36. In this situation, the attachment member 84 is rotatably attached to the end of one of the linear supports 31, so that the attachment member can rotate without rotating the linear support 31.

Figure 9:
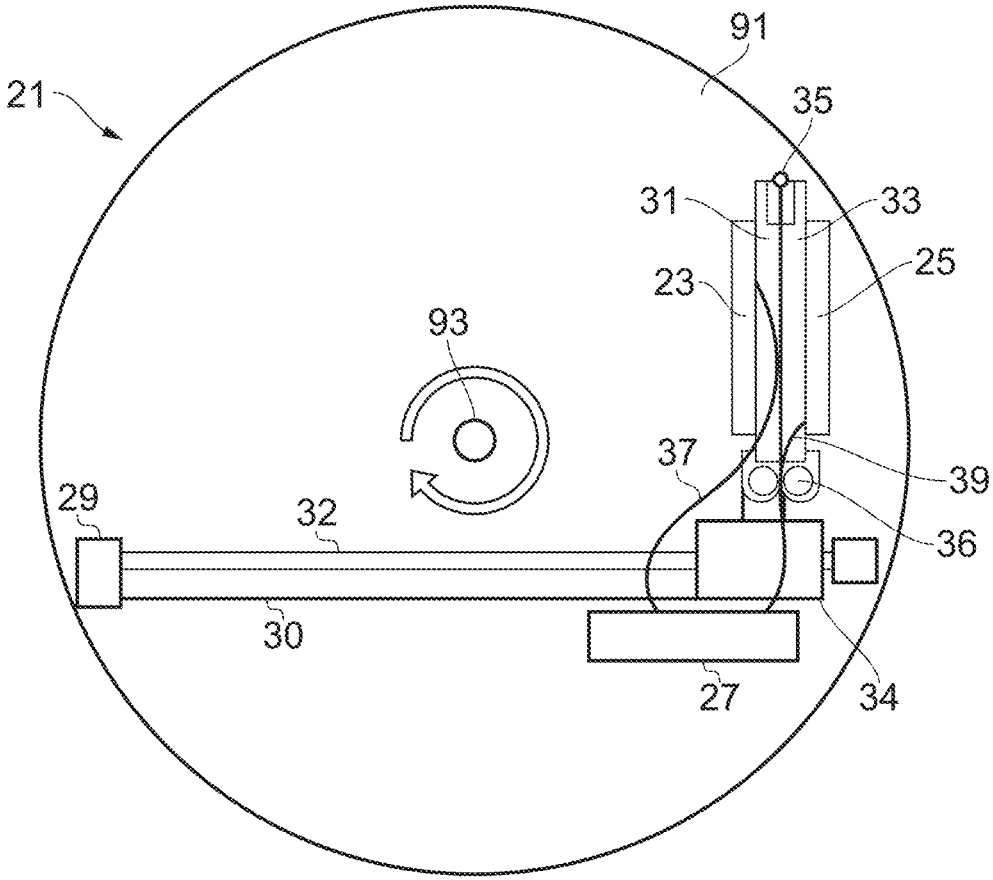
FIG. 9 is a schematic of one example antenna apparatus.

FIG. 9 shows a schematic of the antenna apparatus 21 according to one example configuration of the present technique. In FIG. 9, the antenna apparatus 21 includes a base plate 91 configured to rotate about a further axis of rotation 93, further increasing the size of the area covered by the apparatus 21. For example, any of the beam configurations illustrated in FIG. 7 that are formed by appropriate relative movement of the two antenna arrays can be rotated through 360° by rotation of the plate 91 about the axis 93. The base plate 91 may be coupled to a motor configured to drive its rotation about the axis 93, and the axis 93 is parallel to the common axis of rotation of the antenna arrays 23, 25 defined by the hinge 35. In the example of FIG. 9, the antenna positioning circuitry 29 is integrated into one of the end stops of the linear structure 32.

Figure 10:
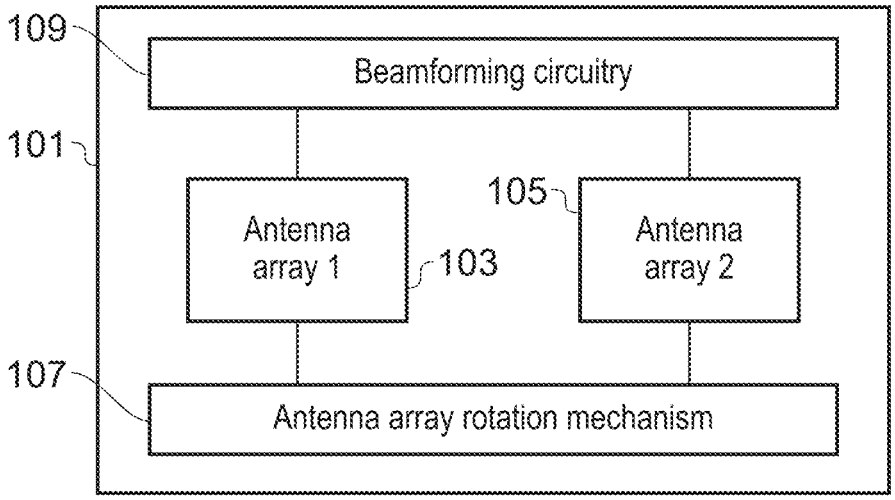
FIG. 10 is a block diagram of an antenna apparatus according to an example of the present technique.

FIG. 10 is a block diagram of an antenna apparatus 101 according to an example of the present technique, where an antenna array rotation mechanism is provided to allow rotation of each antenna array in its antenna array plane so as to cause an associated beamforming plane to rotate.

The antenna apparatus 101 shown in FIG. 10 has two antenna arrays 103, 105, each of which comprises a plurality of antenna elements (not shown) and at least one receive/transmit unit (also not shown). The antenna arrays 103, 105 are each configured to produce a beam for wireless communication with other antenna apparatuses within a wireless communication network, and can be rotated in their respective antenna array planes by the antenna array rotation mechanism 107. Beamforming circuitry 109 is also provided, to electronically steer the beams produced by the two antenna arrays in their respective beamforming planes.

Although the antenna apparatus shown in FIG. 10 contains two antenna arrays, it should be appreciated that an antenna apparatus according to the present technique need not necessarily be restricted to two antenna arrays, and could instead include any number of antenna arrays. Also, in a configuration where two antenna arrays are used, then in addition to the rotation within the antenna array planes in the manner discussed in detail hereafter, those antenna arrays may also be mounted with respect to each other in the manner discussed earlier with reference to FIGS. 2 to 9, to provide further flexibility in how the arrays are moved during use. However it should be noted that the general technique described herein for rotating an antenna array within its antenna array plane to cause the associated beamforming plane to rotate is not restricted to deployments where the mechanical mechanism described earlier with reference to FIGS. 2 to 9 is used.

Figure 11:
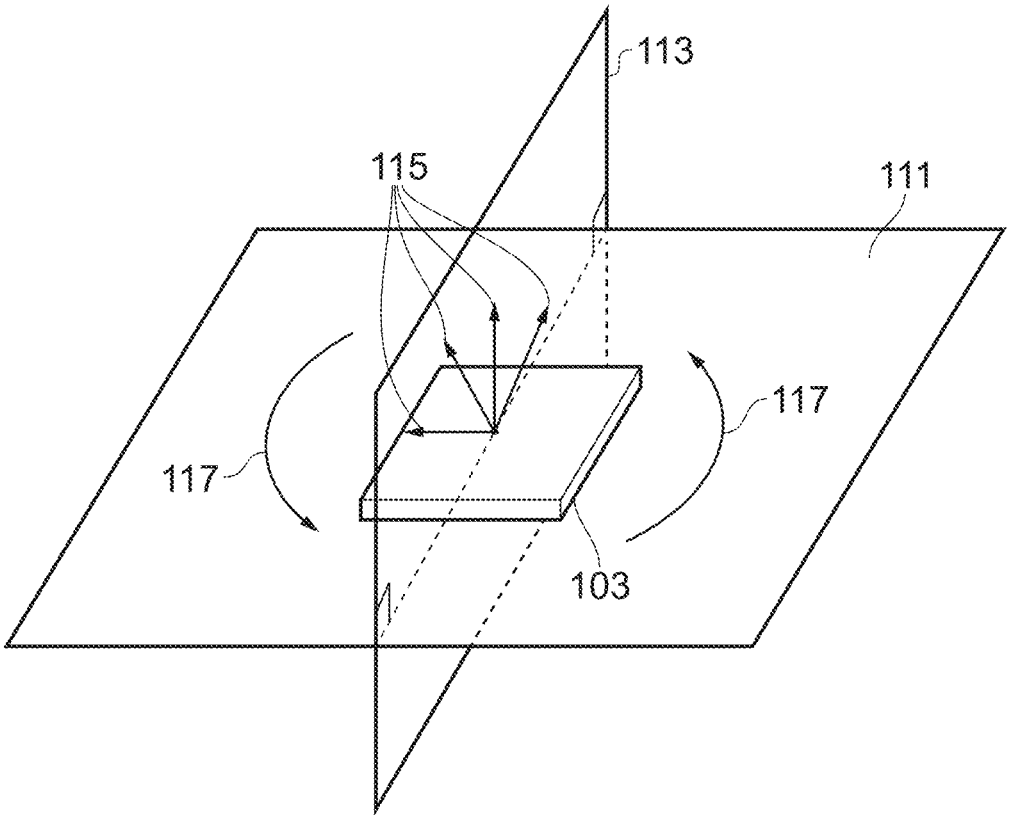
FIG. 11 is a schematic of an antenna array used in one example of the present technique.

FIG. 11 is a diagram showing an antenna array 103 according to the second example configuration of the present technique and its associated antenna array plane 111 and beamforming plane 113. The example in the diagram is of an antenna array 103 that is substantially flat, and its associated antenna array plate 111 is therefore parallel to the antenna array 103 itself. Arrows 115 show possible directions the beam produced by the antenna array 103 can be electronically steered to. As shown in the diagram, the beamforming plane 113, which is the plane in which the beam produced by the antenna array 103 can be electronically steered, contains all of the possible directions 115 to which the beam can be electronically steered. If the antenna array 103 is rotated by antenna array rotation circuitry 107 in its antenna array plane 111, the beamforming plane 113 will also be caused to rotate, allowing the beam to be steered in a wider range of directions. Arrows 117 show the direction of rotation of the antenna array 103 by the antenna array rotation circuitry 107.

Figure 12:
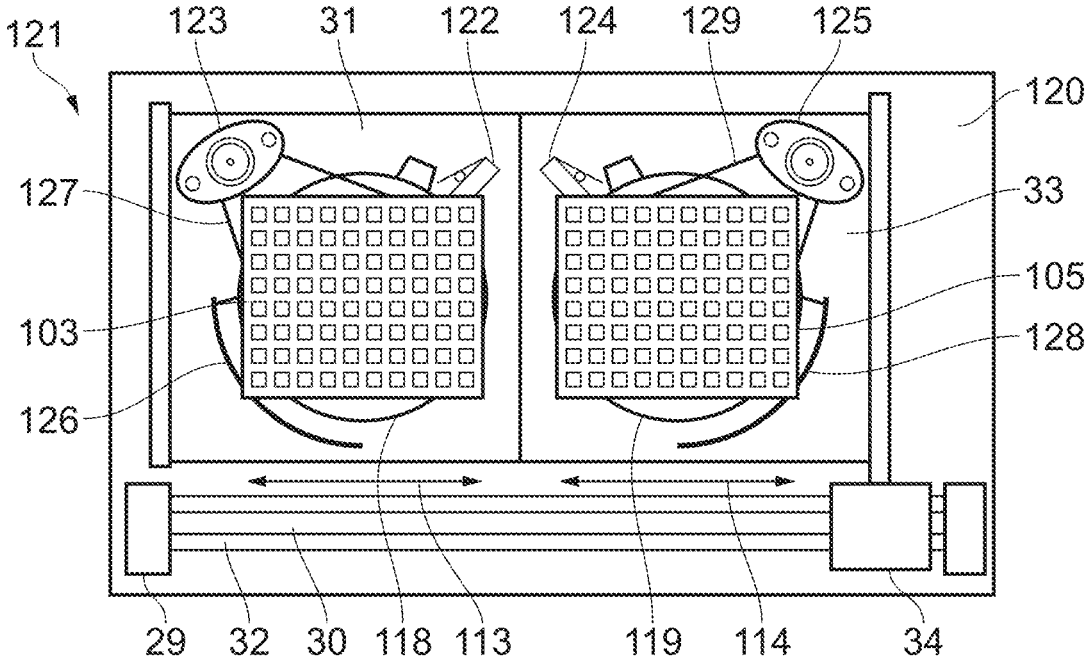
FIGS. 12 to 14 are schematics of an antenna apparatus according to one example of the present technique, viewed from various angles.

In one example deployment, the antenna apparatus described above with reference to FIGS. 10 and 11 can be implemented with the folding mechanism shown in FIGS. 3 to 5, as shown in FIG. 12. FIG. 12 shows an antenna apparatus 121 comprising two antenna arrays 103, 105 mounted on supports 31, 33. Motors 123 and 125 are arranged to cause their associated antenna arrays 103, 105 to rotate in their respective antenna array planes 111. In the configuration shown in FIG. 12, the antenna array planes 111 are in the plane of the page. The motors 123, 125 may be arranged to cause the antenna arrays 103, 105 to rotate in any of a number of ways, but in the example of FIG. 12 they are coupled to belts 127, 129, which are in turn coupled to pulleys 118, 119 attached to the antenna arrays 103, 105. Motors 123, 125, pulleys 118, 119 and belts 127, 129 together form an example of an antenna array rotation mechanism 107, although any other rotation mechanism can be used instead. Limit switches 122 and 124 may be used to prevent the antenna arrays 103, 105 from rotating too far, and flexible cable slots 126 and 128 are positioned to guide flexible cables running from the antenna arrays 103, 105 during the rotation of the antenna arrays 103, 105.

The supports 31, 33 are attached by a hinge (not shown) which allows the motion of one antenna array 103, 105 relative to the other, and defines a common axis of rotation about which the antenna arrays 103, 105 are configured to move.

One end of one of the supports 33 is coupled to a linear structure 32 by an attachment member 34 (in contrast to the example in FIG. 3, it is the support member 33 rather than the support member 31 that is connected to the attachment member 34 in the example of FIG. 12). In this example, the attachment member 34 is configured to be slideable along the linear structure 32, which in this case may be a linear track, allowing the end of the support 33 to be linearly translated along the linear support, such as to vary the angle between the antenna arrays 103, 105. The antenna apparatus 121 also includes antenna positioning circuitry 29 which includes a motor (not shown separately) configured to move the attachment member 34 along the linear structure 32. The motor in the antenna positioning circuitry 29 is coupled to the attachment member 34 by a drive mechanism 30, which can be any suitable means that enables the motor to drive the attachment member 34, and is merely shown schematically in the figures by the element 30. The antenna positioning circuitry 29 includes electronics configured to control the relative motion of the antenna arrays 103, 105. The motor does not necessarily need to be integrally formed with the antenna positioning circuitry as in FIG. 12, but can instead be separate. Further, the antenna positioning circuitry can be provided at any suitable location within the apparatus, but in FIG. 12 is shown as being attached to, or integral with, one of the end stops of the linear structure 32. However, it can be useful for the motor position to be static so as to reduce the complexity of moving parts and the amount of flexible cabling.

One end of the other support 31 is fixed relative to the linear structure 32 at an anchor point. As a result of this, motion of the end of the first support 33 along the linear structure 32 increases or decreases the angle between the antenna arrays 103, 105 between a first limit and a second limit, such that a particular deployment configuration can be selected from between the first and second limits.

FIG. 12 also shows a mounting plate 120, arranged to support the antenna arrays 103, 105. The linear track 32 may be fixed to the mounting plate 120, and the mounting plate 120 may be configured to rotate about an axis directed out of the page, in order to cause further rotation of the antenna arrays together. Arrows 113 and 114 show the orientation of the beamforming planes of the two antenna arrays 103, 105.

Figure 13:
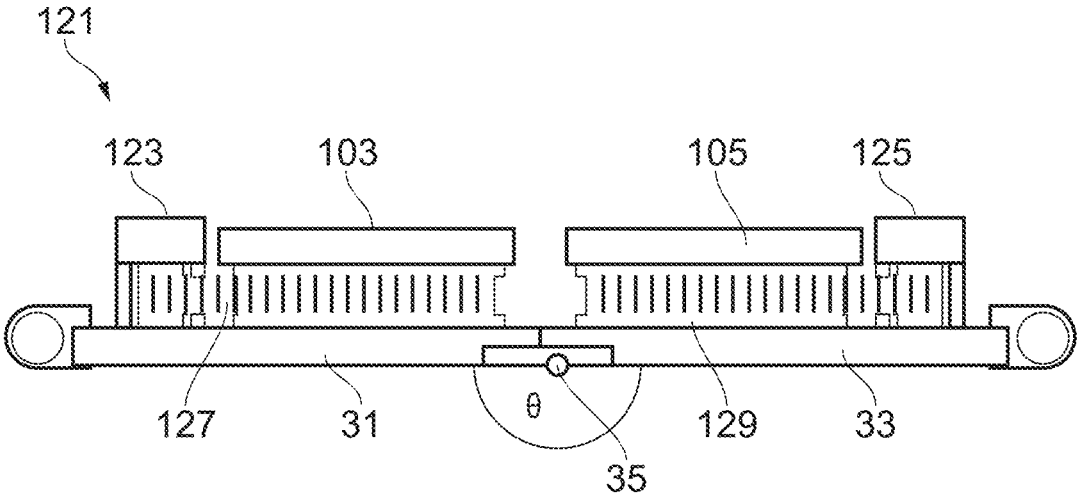

FIG. 13 shows a schematic of a side view of the antenna apparatus 121 depicted in FIG. 12. In this figure, hinge mechanism 35, which couples the two supports 31, 33, can be seen. The hinge 35 allows the supports 31, 33 to be moved such as to vary the angle θ between them, where the angle θ also defines the angle between the antenna arrays 103, 105.

Figure 14:
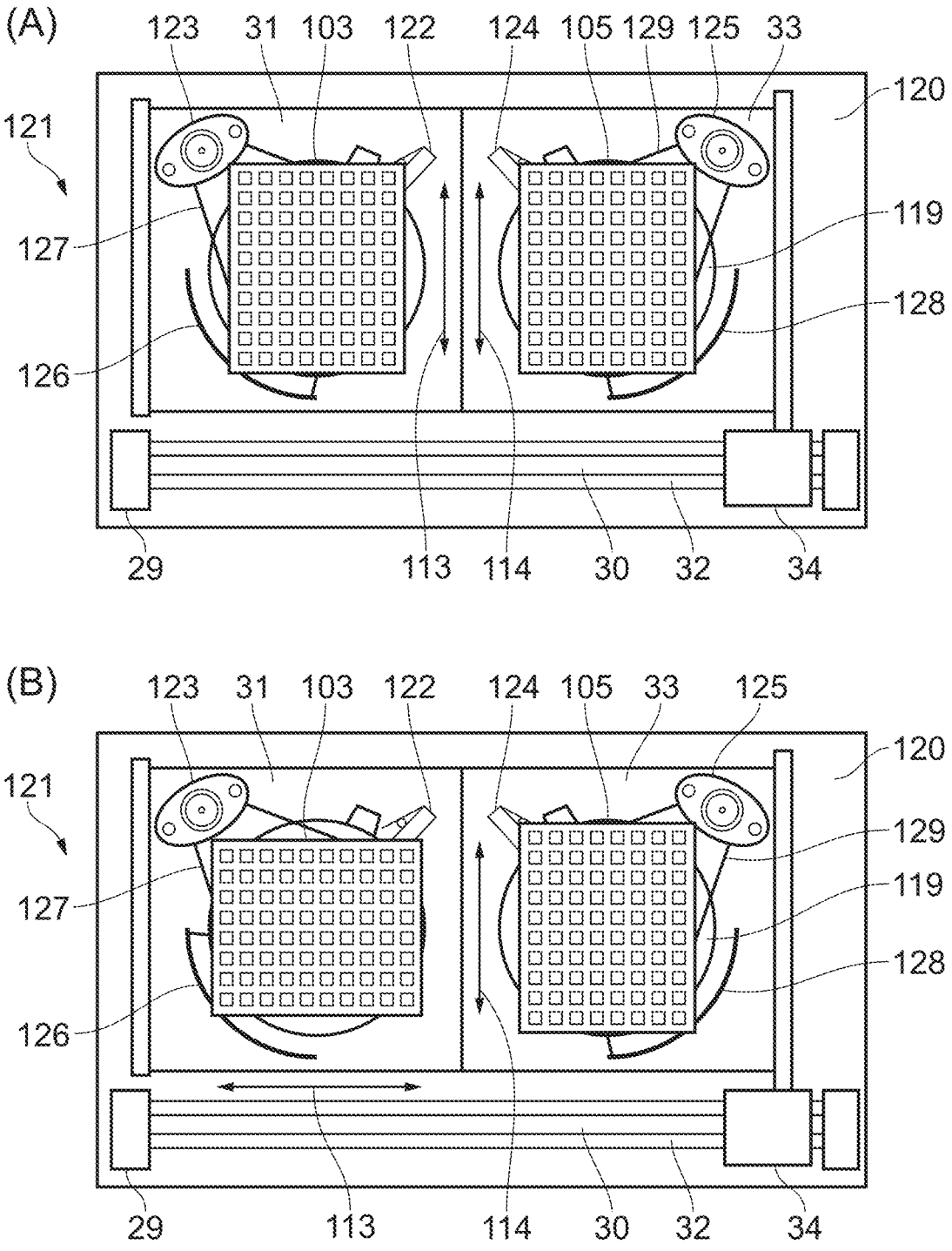

FIG. 14 shows the antenna apparatus 121 of FIGS. 12 and 13 in two example configurations. In FIG. 14A, both antenna arrays 103, 105 have been rotated by 90° relative to their positions in FIG. 12. In this example, as the two antenna arrays 103, 105 have been rotated by the same amount, their beamforming planes 113, 114 are in alignment.

In FIG. 14B, one of the antenna arrays 105 has been rotated by 90° relative to its position in FIG. 12, causing its beamforming plane 114 to be rotated by 90°, while the other antenna array 103 has not been rotated. The beamforming planes 113, 114 of the two antenna arrays are, therefore, perpendicular to each other in this example.

Figure 15:
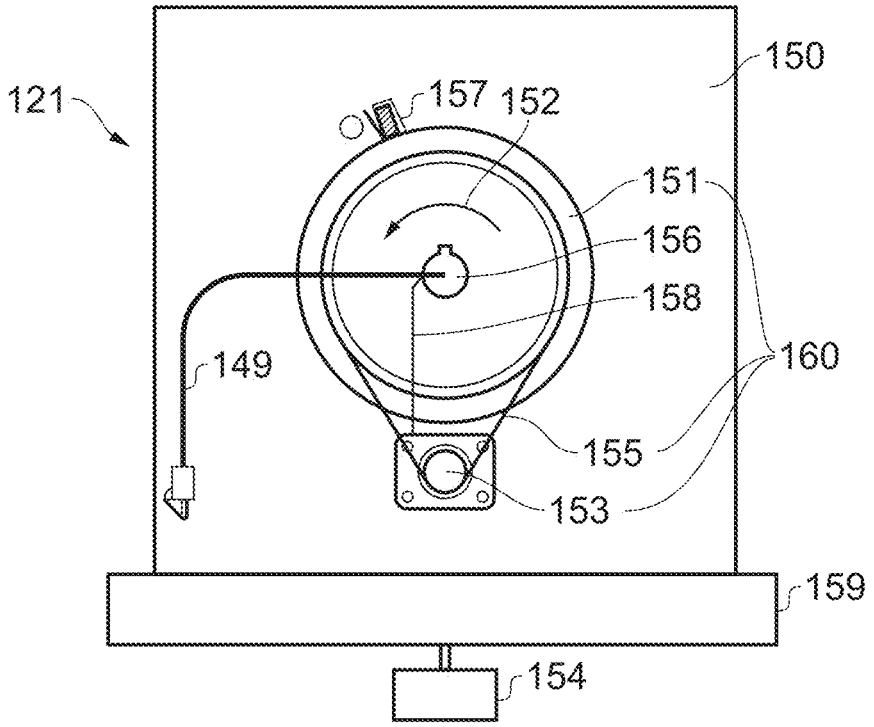
FIGS. 15 to 17 are schematics of an antenna apparatus according to one example of the present technique, viewed from various angles.
Figure 16:
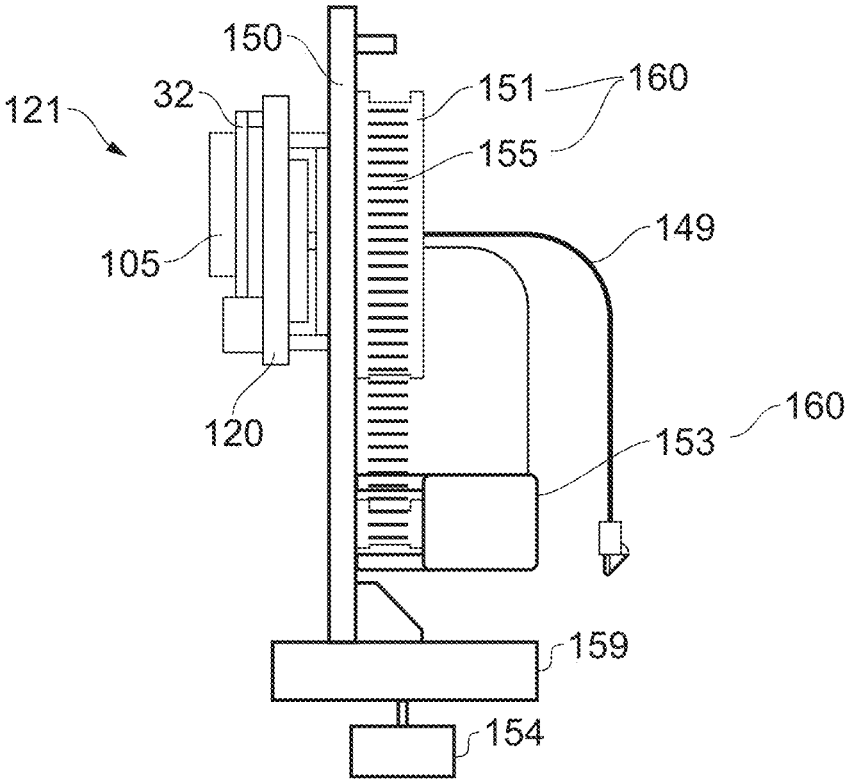
Figure 17:
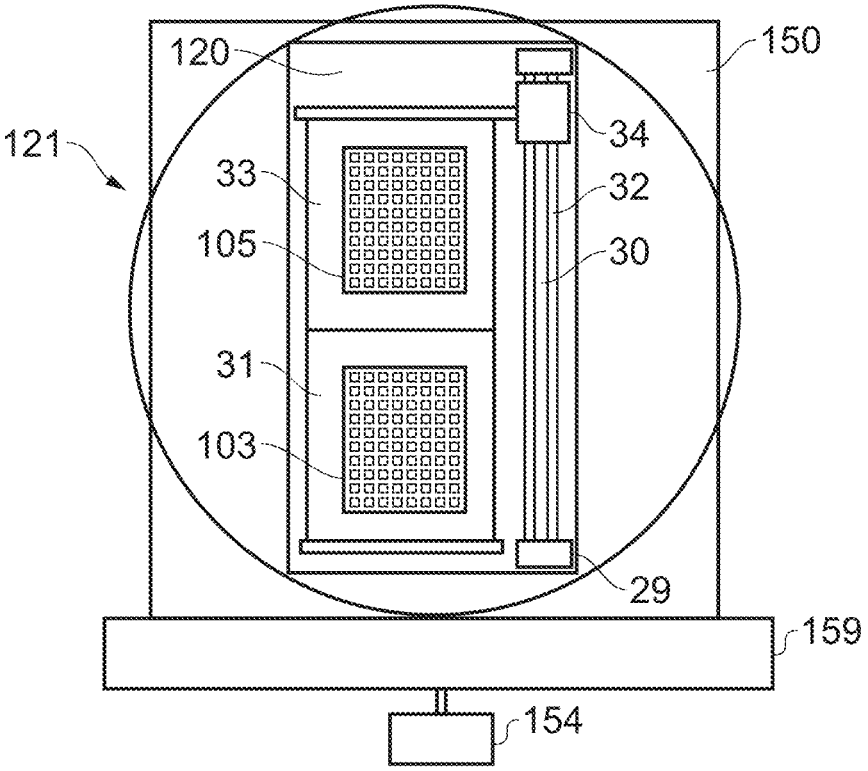

FIGS. 15 to 17 show a reverse view, a side view and a front view respectively of the antenna apparatus 121, showing fixed plate 150, onto which the mounting plate 120 is itself mounted. Attached to the mounting plate 120 is a pulley 151, which is coupled to a motor 153 by a belt 155, together forming a mounting plate rotation mechanism 160 configured to cause the mounting plate to rotate about an axis directed out of the page, as shown by arrow 152. A limit switch 157 is also shown, which prevents the mounting plate from being rotated beyond some predetermined limit. The fixed plate 150 of FIG. 15 is shown mounted on a base plate 159, which is configured to be rotated about an axis perpendicular to the axis of rotation of the mounting plate by a further rotation mechanism 154.

FIG. 15 also shows bearing 156 with a centre hole through which cables can be fed, including motor cable 158 for providing power to the motor 153, and a further cable 149 for supplying power to the antenna apparatus 121 and for facilitating the transfer of data to or from the antenna arrays 103, 105.

In FIG. 17, the mounting plate 120 has been rotated by 90° relative to the arrangement shown in FIGS. 12 to 14, showing an example configuration of the antenna apparatus 121.

Figure 18:
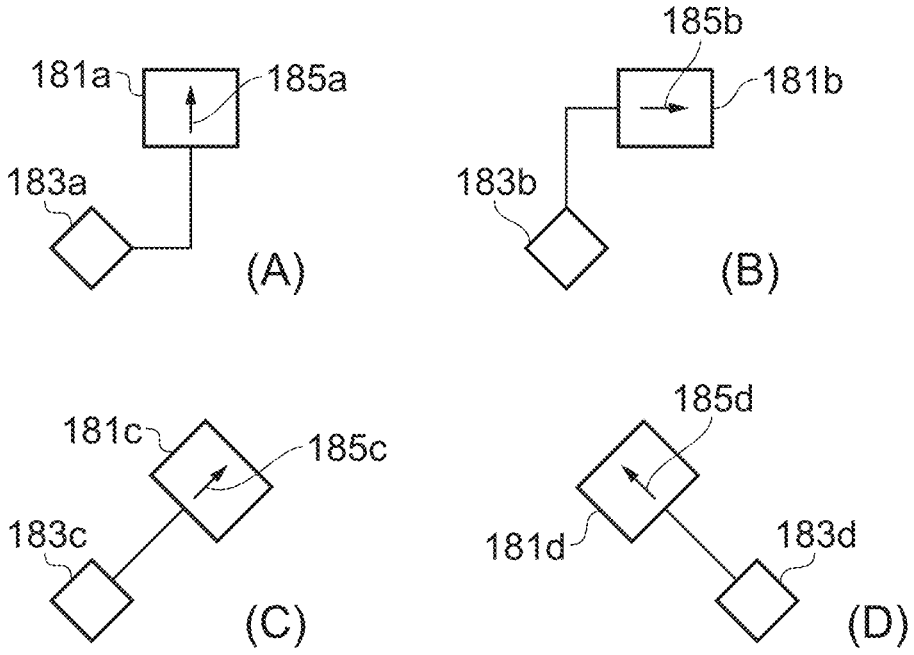
FIG. 18 is a schematic of antenna elements used in one example of the present technique.

FIG. 18 shows examples of how the transceivers 183 (also known as transmit/receive units) and antenna elements 181 can be coupled. As the figure shows, the position on the antenna element 181 where the transceiver 183 is attached determines the direction of current flow (shown by arrows 185) in the antenna element 181. The flow of current in the antenna elements 181 in turn determines the polarization direction of a beam associated with the antenna elements 181; thus, in FIG. 18A, the beam would be vertically polarized, in FIG. 18B it would be horizontally polarized and in FIGS. 18C and 18D the beams would be +45° and −45° polarized respectively.

Figure 19:
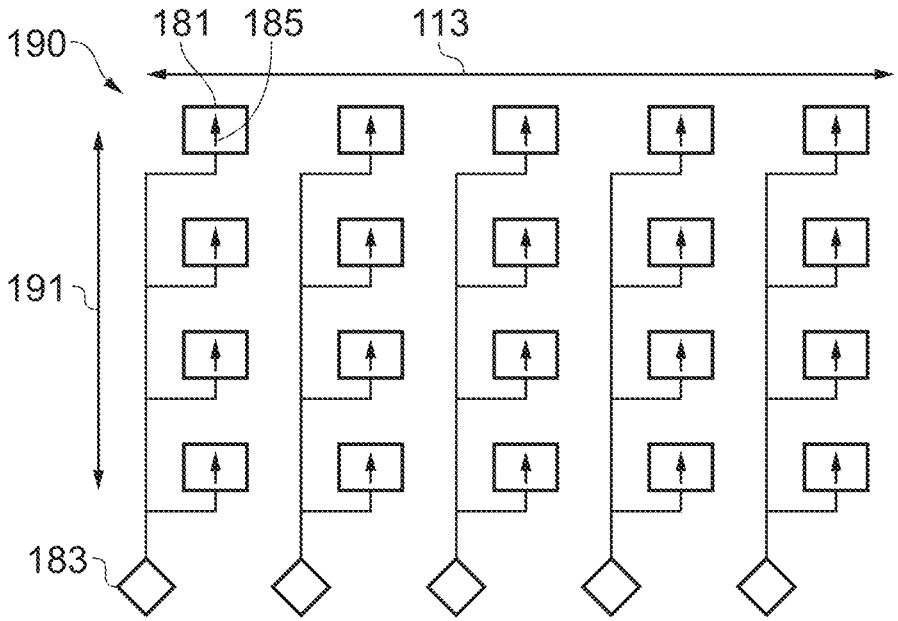
FIG. 19 is a schematic of an antenna array used in one example of the present technique.

FIG. 19 shows an example of an antenna array 190 in which the plurality of antenna elements 181 are arranged into interconnected groups, each connected to a single transceiver 183. In this particular example, the antenna elements 181 are arranged in a grid formation, in four rows of five. Each interconnected group contains four antenna elements 181, and current is fed into each antenna element 181 in the same direction (vertically in this example) so as to define a polarization plane 191 for the array. The beamforming plane 113 for the antenna array 190 is also determined by how the antenna elements 181 are interconnected; the beam produced by the antenna array 190 cannot be electronically steered in the vertical direction, due to each of the vertical columns of antenna elements 181 sharing a single transceiver. Connecting the antenna elements 181 in groups, each group having a single transceiver 183, provides an efficient configuration of the antenna array 190, with reduced hardware cost.

Figure 20:
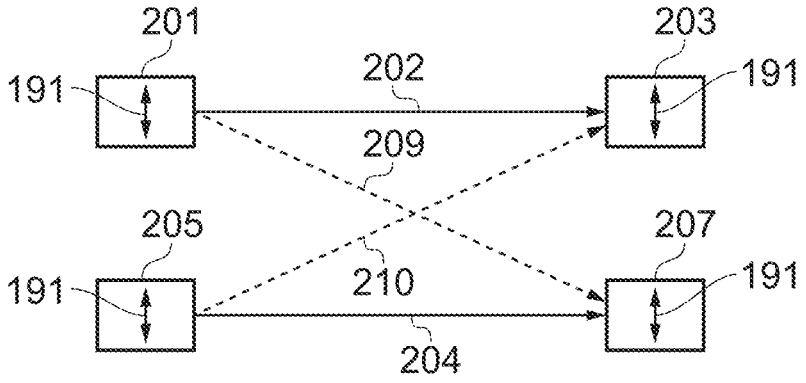
FIG. 20 is a diagram showing potential interfering signals between two antenna apparatuses.

FIG. 20 shows an example of four antenna arrays 201, 203, 205, 207 in communication. A first antenna apparatus has two antenna arrays 201, 205 that are acting as transmitters in this example, generating beams 202, 204 to be received by another two antenna arrays 203, 207 within a further antenna apparatus, which are acting as receivers. Both antenna apparatuses may be configured as per the examples discussed earlier, and in particular may allow each antenna array to be independently rotated in its antenna array plane. In the illustrated example, antenna array 201 is in communication with antenna array 203 via beam 202 and antenna array 205 is in communication with antenna array 207 via beam 204. In the example of FIG. 20, all four antenna arrays 201, 203, 205, 207 have parallel polarization planes 191, leading to cross coupling between the two signals 202, 204. In other words, because both receivers 203, 207 are configured to receive signals that are vertically polarized, and both transmitters 201, 205 are configured to transmit vertically polarized signals, part 209 of the signal 202 from antenna array 201 is received by antenna array 207 and interferes with signal 204, and part 210 of the signal 204 from antenna array 205 is received by antenna array 203 and interferes with signal 202. For this reason, it can be beneficial to rotate one antenna array within each antenna apparatus (for example the antenna arrays 205, 207) by 90° so that the polarization planes 191 are no longer aligned. This will reduce the interference between the two beams.

Figure 21:
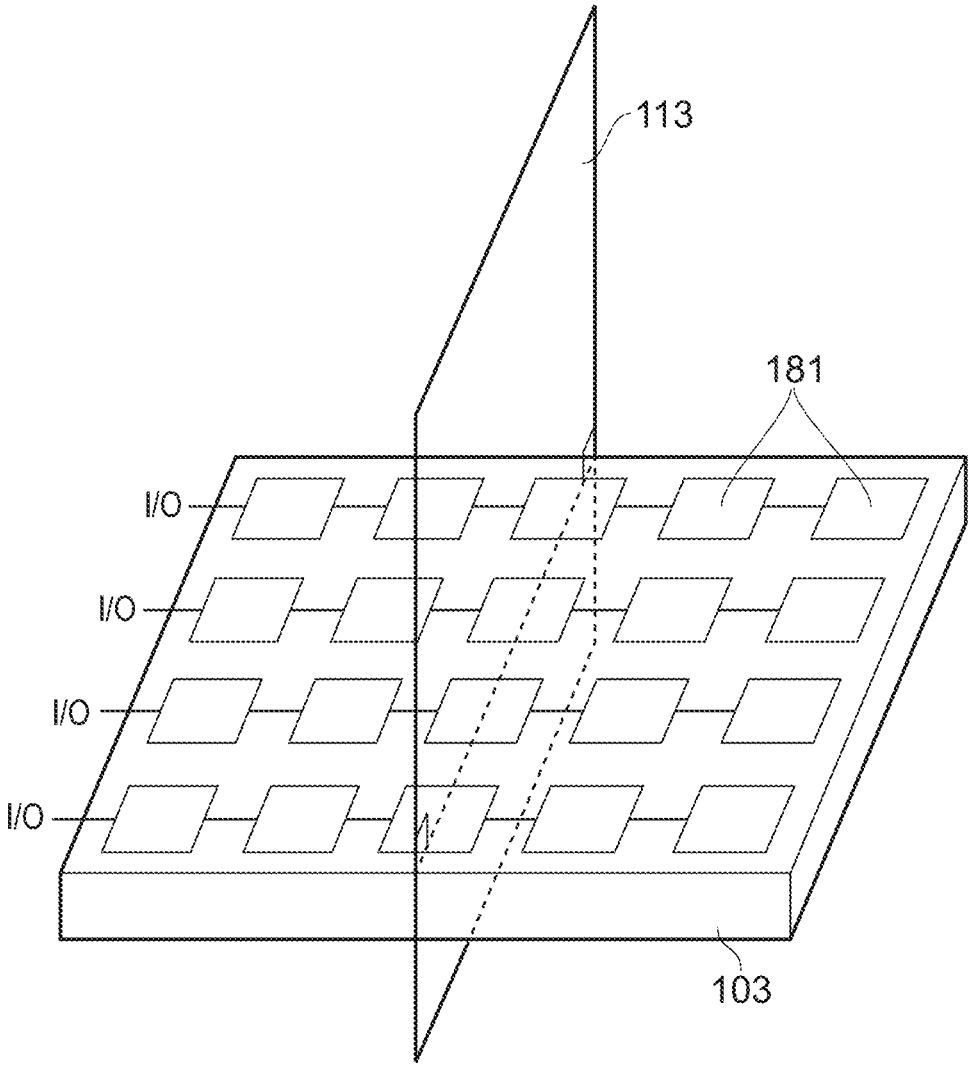
FIG. 21 is a schematic of an antenna array used in one example of the present technique.

FIG. 21 is a schematic of an antenna array 103 showing the relationship between the beamforming plane 113 and the interconnected groups of antenna elements 181. Each interconnected group in FIG. 21 is shown sharing a single input/output (I/O) feed, and the beamforming plane 113 is perpendicular to the interconnected groups.

Figure 22:
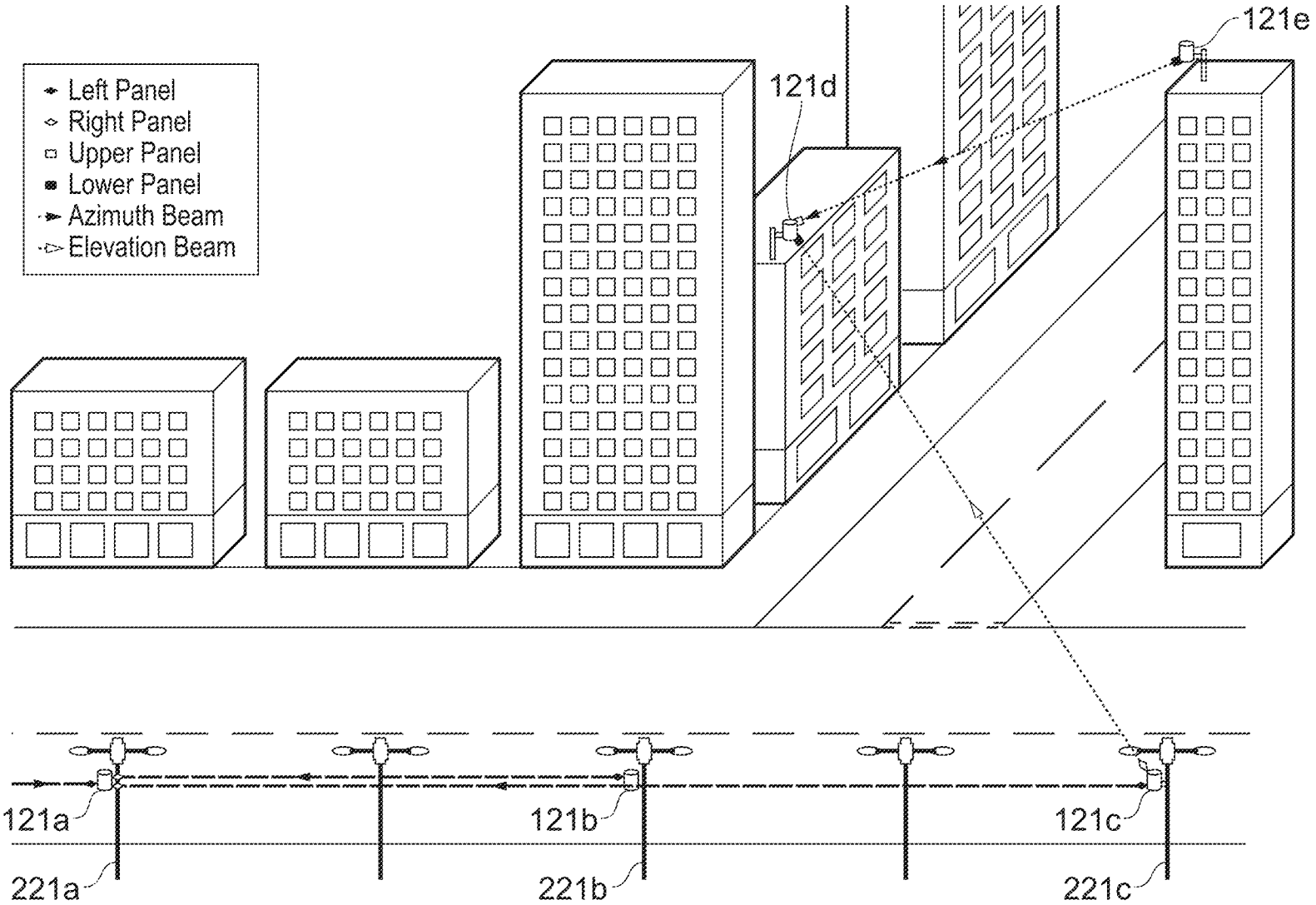
FIGS. 22 to 24 are schematics of a communication network according to an example of the present technique.
Figure 23:
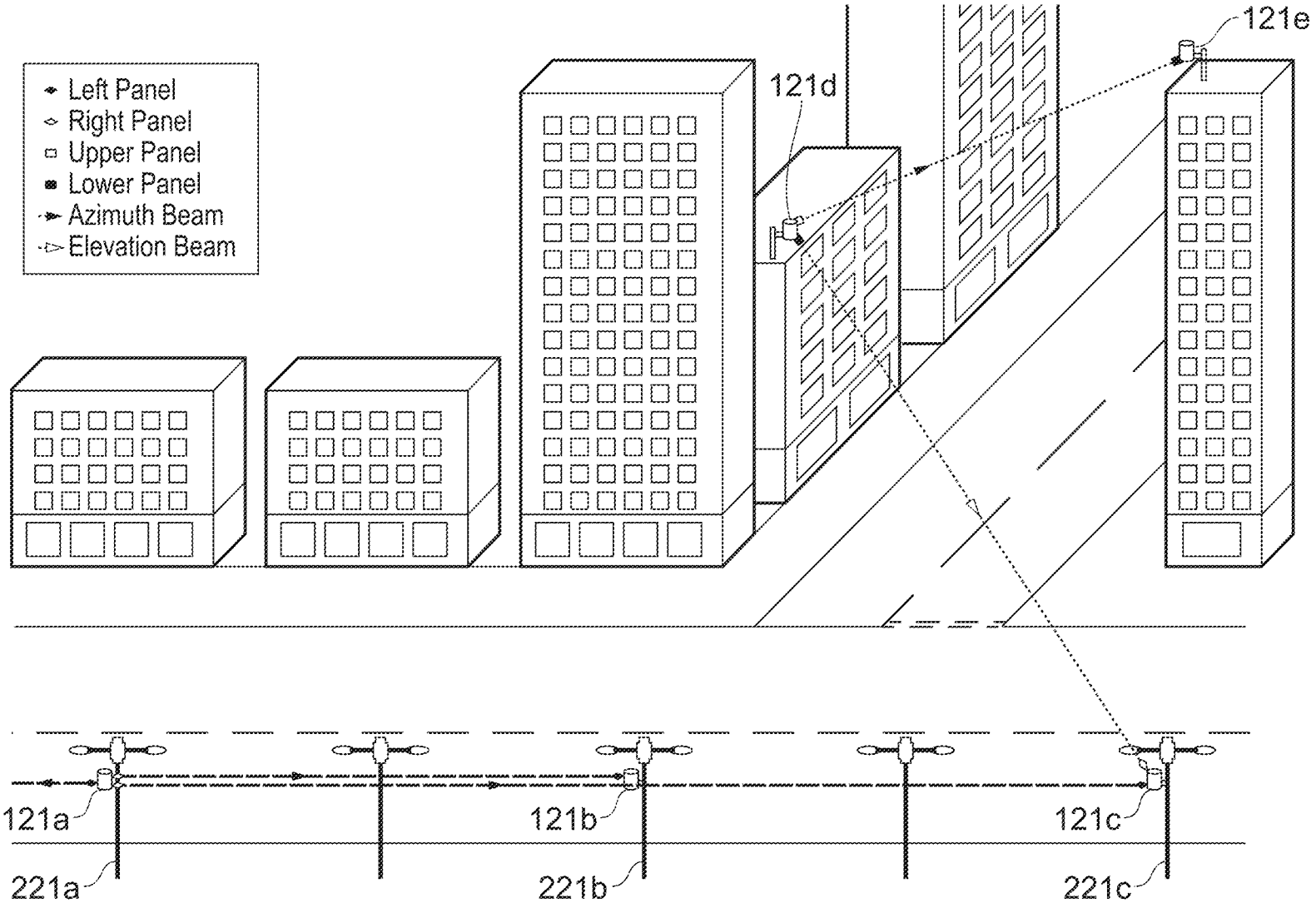
Figure 24:
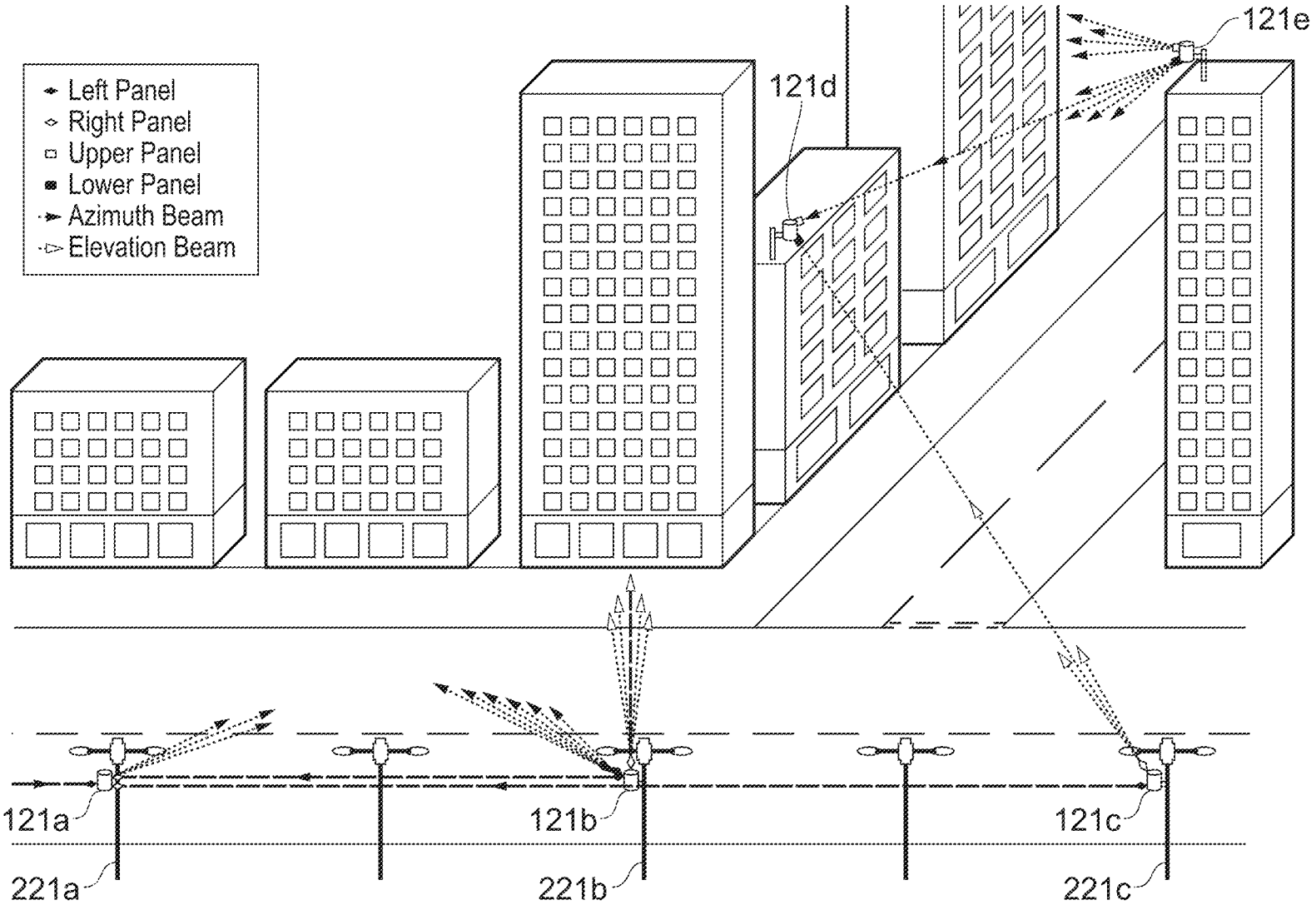

FIGS. 22 to 24 show examples of how the antenna apparatus 121 described above can be deployed in a wireless communication network, in this example it being assumed that the deployment environment is a densely packed urban environment. In the figures, a portion of a wireless communication network including five antenna apparatuses 121*a* to 121*e* according to the present technique is shown. Three antenna apparatuses 121*a*, 121*b*, 121*c* are mounted on lampposts 221*a*, 221*b*, 221*c* whilst another two antenna apparatuses 121*d* and 121*e* are mounted on buildings. The various antenna apparatuses can be used as relay nodes within the network, as shown in FIGS. 22 and 23, for example to form a backhaul network, but in addition, or alternatively, one or more of the antenna apparatuses may act as base station access points within the network to provide points of access into the communication network for items of user equipment deployed within the coverage area of the network. Typically, not all of the antenna apparatuses 121*a*, 121*b*, 121*c*, 121*d*, 121*e* will be deployed at the same time. For example, if antenna apparatus 121*d* is deployed later than antenna apparatus 121*c*, the antenna arrays in antenna apparatus 121*c* may need to be adjusted to communicate with antenna apparatus 121*d*. The rotation mechanisms 107, 160 and 154 of the present technique allow this adjustment to be made with ease, and indeed in implementations where the additional rotation mechanism illustrated for example in FIG. 3 is employed, this can further improve flexibility in the way that the antenna arrays of any particular antenna apparatus can be adjusted post-deployment to take into account other antenna apparatuses that it is to communicate with.

FIGS. 22 to 24 also show how it can be beneficial to rotate a pair of antenna arrays 103, 105 using mounting plate rotation mechanism 160 by 90° from a horizontal configuration to a vertical configuration (as shown in FIG. 17). In FIGS. 22 and 23, antenna apparatuses 121*a* and 121*b* are in a horizontal configuration. This configuration is appropriate in this case because these two antenna apparatuses are only in communication with other apparatuses (e.g. each other) on approximately the same elevation. Thus, the antenna arrays 121*a* and 121*b* do not require significant freedom to steer their beams in a vertical direction. Antenna apparatus 121*c* can also be arranged in a horizontal configuration but the right-hand side panel can be rotated in its antenna array plane using the mechanism discussed earlier with reference to FIG. 12 to enable vertical beam steering to facilitate communication with antenna apparatus 121*d*. Meanwhile, antenna apparatuses 121*d* and 121*e* have been rotated by 90° using mounting plate rotation mechanism 160 to be in a vertical configuration. This is beneficial for these apparatuses because they are at significantly different elevations, so require significantly more freedom to steer their beams in a vertical direction in order to be able to communicate with each other. As this example demonstrates, the present technique provides an antenna apparatus that is especially well suited to densely populated urban areas.

FIGS. 22 and 23 illustrate two stages of communication in the portion of the communication network shown, where the various antenna apparatuses 121*a* to 121*e* are operated as a relay network using time division duplexing (TDD) to manage communication between them. In FIG. 22, during TDD phase 1, antenna apparatuses 121*a* and 121*d* act as receivers and antenna apparatuses 121*b*, 121*c* and 121*e* act as transmitters, whilst as shown in FIG. 23, during TDD phase 2, these operations are reversed. In the configuration shown, antenna apparatuses 121*a*, 121*b* and 121*c* are each in a "left-right" configuration, where the antenna arrays (panels) are arranged side-by-side. The arrays of apparatuses 121*a* and 121*b* are rotated to allow for electronic beamsteering in the horizontal (azimuth) plane, allowing them to communicate with other antenna apparatuses mounted on lamp posts at approximately the same height. The same is true of the left panel of apparatus 121*c*. On the other hand, since the right panel of antenna apparatus 121*c* is required to communicate with an apparatus at a height different to the height of apparatus 121*c* itself (specifically apparatus 121*d* mounted on top of a building), this panel is rotated so as to allow electronic beamsteering in a vertical (elevation) plane. Mechanical beamsteering in the horizontal plane (e.g. using the folding apparatus mechanism depicted in FIGS. 3 to 5, 8 to 9 and 12 to 17) can also be used as necessary to alter the relative direction in which the left and right panels are pointed as required.

However, this is just one possibility for configuring antenna apparatus 121*c*—in another example, the panels in this apparatus may be arranged in an "up-down" arrangement, where one panel is above the other, as for example shown in FIG. 17. However, rather than arranging the panels as shown in FIG. 17 (which allow for beamsteering in the vertical plane), both the upper panel and the lower panel may be rotated to allow for electronic beam steering in the horizontal (azimuth) direction. Beamsteering in the vertical plane can then be achieved by using mechanical beamsteering (e.g. using the folding apparatus mechanism depicted in FIGS. 3 to 5, 8 to 9 and 12 to 17) to alter the relative direction in which the upper and lower panels are pointed as required.

In the illustrated example of FIGS. 22 to 24, antenna apparatus 121*d* is also arranged in an "up-down" arrangement, which is appropriate in this example since it is required to communicate with apparatuses 121*c* and 121*e*, which are at significantly different heights. Similarly antenna apparatus 121*e* is also arranged in an "up-down" arrangement, with the lower panel being used to communicate with antenna apparatus 121*d*.

In the above discussions, "azimuth" and "elevation" directions are referred to. In this description, "azimuth" is analogous with "horizontal" and refers to the "left-right" direction, while "elevation" is analogous with "vertical" and refers to the "up-down" direction.

FIG. 24 shows an alternative configuration of the various antenna apparatuses 121*a* to 121*e*, where the antenna apparatuses 121*a*, 121*b*, 121*c* and 121*e* are each broadcasting in point-to-multipoint mode, and act as base station access points for items of user equipment within the network. The relay functionality can also be maintained in this example configuration.

Figure 25:
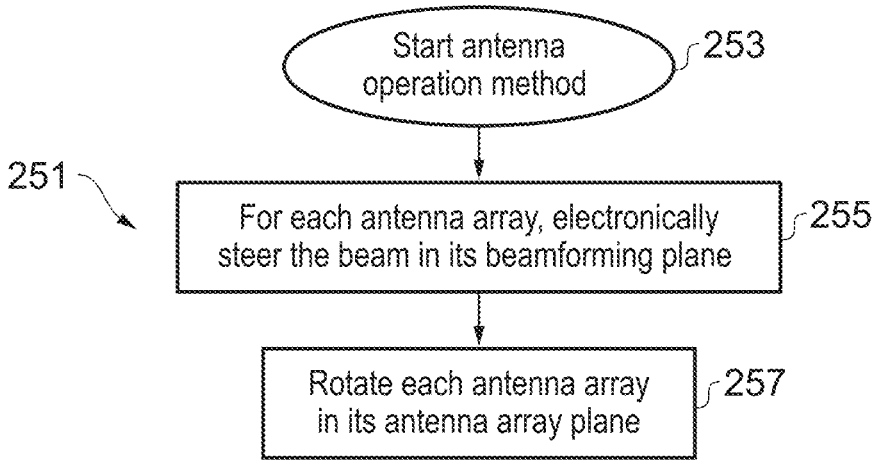
FIG. 25 is a flow diagram of a method of operation of an antenna apparatus according to one example of the present technique.

FIG. 25 is a flow diagram depicting a method 251 of operating an antenna apparatus 101, 121 according to the present technique. The method starts at step 253, and in step 255, beamforming circuitry 109 electronically steers the beam produced by each antenna array 103, 105 in its associated beamforming plane. In step 257, the antenna array rotation mechanism 107 rotates each antenna array 103, 105 in its associated antenna array plane, causing its beamforming plane to rotate.

Figure 26:
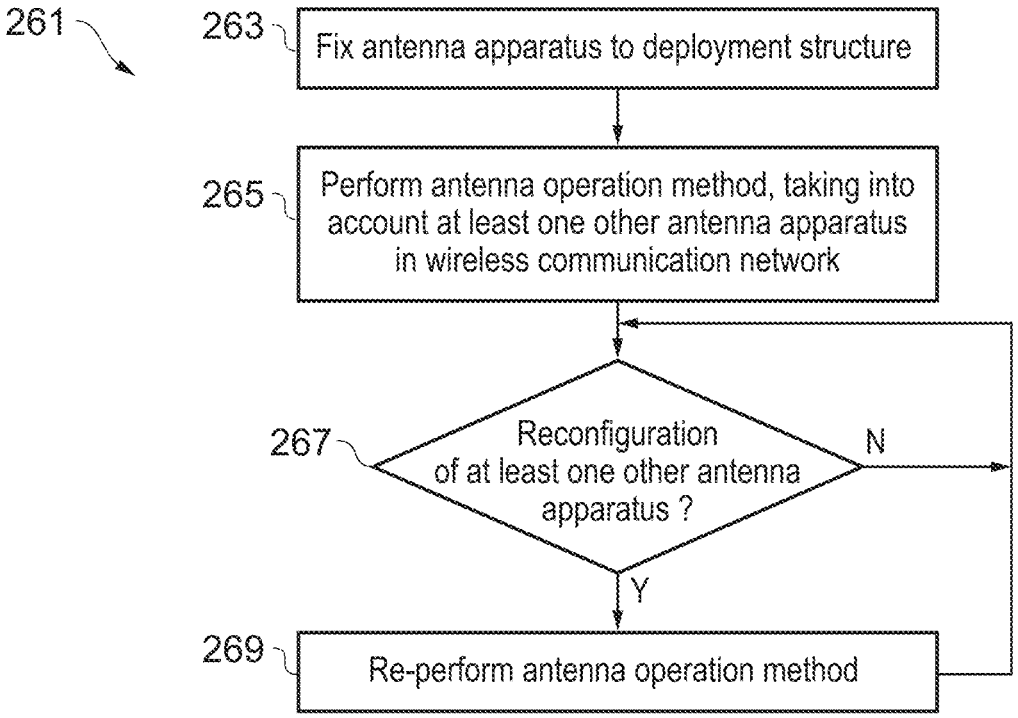
FIG. 26 is a flow diagram of a method of deploying an antenna apparatus within a communication network, according to one example of the present technique.

FIG. 26 is a flow diagram of a method 261 of deploying an antenna apparatus 101, 121 within a wireless communication network. In step 263, an antenna apparatus 101, 121 according to the present technique is fixed to a deployment structure, such as a lamppost or the side of a building. In step 265, the antenna operation method 251 is carried out, taking into account at least one other antenna apparatus in the wireless communication network. In step 267, the antenna apparatus 101, 121 determines whether at least one other antenna apparatus in the wireless communication network has been reconfigured. This determination may be performed automatically within the antenna apparatus, or may involve a check process being invoked by an externally generated control signal, for example through interaction with a person managing the deployment/configuration process of the network in which the antenna apparatus is deployed. If it is determined that no reconfiguration of the at least one other antenna apparatus in the network has occurred, the method remains at step 267. If it is determined that at least one antenna apparatus in the communication network has been reconfigured, the method passes to step 269, in which the antenna operation method 251 is re-performed, taking into account the reconfigured antenna apparatus. The method then returns to step 267 and the antenna apparatus 101, 121 continues to check whether at least one other antenna apparatus in the wireless communication network has been reconfigured.

From the above described examples, it will be appreciated that the present technique provides an antenna apparatus capable of producing a narrow beam, but with the ability to flexibly steer that beam post-deployment using a combination of electronic beamforming and mechanical rotation mechanisms, providing a very flexible, cost-effective, antenna apparatus. The present technique allows the antenna arrays to be adjusted after deployment without physically revisiting the deployment site to adjust the antenna arrays. This provides a great deal of flexibility, allowing the beams produced by the antenna apparatus to be adjusted to take account of the installation site, and to be adjusted in use to take into account changes made to the infrastructure of the network in which the antenna apparatus is used, or changes in the physical environment in which the antenna apparatus is deployed.

In the present application, the words "configured to . . . " are used to mean that an element of an apparatus has a configuration able to carry out the defined operation. In this context, a "configuration" means an arrangement or manner of interconnection of hardware or software. For example, the apparatus may have dedicated hardware which provides the defined operation, or a processor or other processing device may be programmed to perform the function. "Configured to" does not imply that the apparatus element needs to be changed in any way in order to provide the defined operation.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope of the invention as defined by the appended claims.

The invention claimed is:

1. An antenna apparatus, comprising:

a plurality of antenna arrays, each antenna array having an associated antenna array plane and configured to produce a beam to facilitate wireless communication with at least one other antenna apparatus;

beamforming circuitry configured, for each antenna array, to electronically steer the beam in an associated beamforming plane;

an antenna array rotation mechanism configured to rotate each antenna array in its antenna array plane so as to cause the associated beamforming plane to rotate;

a mounting plate to support the plurality of antenna arrays;

a mounting plate rotation mechanism configured to rotate the mounting plate about a first axis; and a further rotation mechanism configured to rotate the plurality of antenna arrays about a second axis perpendicular to the first axis.

2. The antenna apparatus according to claim 1, wherein each antenna array is configured such that the associated beamforming plane is perpendicular to the associated antenna array plane.

3. The antenna apparatus according to claim 1, wherein:

the antenna array rotation mechanism is configured to rotate the plurality of antenna arrays independently of each other.

4. The antenna apparatus according to claim 1, further comprising antenna array control circuitry configured to coordinate operation of the plurality of antenna arrays dependent on the rotation of the plurality of antenna arrays.

5. The antenna apparatus according to claim 1, wherein:

for each antenna array, the beam has an associated polarization plane; and the rotation of each antenna array further causes the associated polarization plane to rotate.

6. The antenna apparatus according to claim 5, wherein:

the plurality of antenna arrays comprise a first antenna array and a second antenna array; and the antenna array rotation mechanism is configured to rotate the first and second antenna arrays such that the polarization plane of the first antenna array is perpendicular to the polarization plane of the second antenna array.

7. The antenna apparatus according to claim 1, wherein:

each antenna array comprises a plurality of antenna elements; and for each antenna array, the plurality of antenna elements are arranged into interconnected groups, each group being associated with a single receive/transmit unit.

8. The antenna apparatus according to claim 7, wherein:

for each antenna array, the plurality of antenna elements are arranged in a grid formation in the antenna array plane; and the interconnected groups each comprise a line of antenna elements, the lines being parallel.

9. The antenna apparatus according to claim 8, wherein the beamforming plane is perpendicular to the lines of antenna elements.

10. The antenna apparatus according to claim 1, wherein the antenna array rotation mechanism comprises a rotation unit for each antenna array.

11. The antenna apparatus according to claim 10, wherein:

each antenna array is configured to be mounted on an associated support; and each rotation unit comprises a motor configured to drive rotation of the support of the associated antenna array.

12. The antenna apparatus according to claim 1, wherein the antenna array rotation mechanism is configured to be operated remotely.

13. The antenna apparatus according to claim 1, further comprising antenna array rotation selection circuitry, configured to select a chosen rotation for each antenna array.

14. An antenna apparatus, comprising:

a plurality of antenna arrays, each antenna array having an associated antenna array plane and configured to produce a beam to facilitate wireless communication with at least one other antenna apparatus, wherein the plurality of antenna arrays comprise a first antenna array and a second antenna array;

beamforming circuitry configured, for each antenna array, to electronically steer the beam in an associated beamforming plane;

an antenna array rotation mechanism configured to rotate each antenna array in its antenna array plane so as to cause the associated beamforming plane to rotate; and antenna positioning circuitry configured to move the first antenna array relative to the second antenna array about a common axis of rotation to facilitate positioning of the first and second antenna arrays in a chosen deployment configuration between a first limit and a second limit.

15. The antenna apparatus according to claim 14, wherein:

at the first limit, the first and second antenna arrays are positioned adjacent to each other to face in a same direction; and at the second limit, the first and second antenna arrays are positioned back-to-back to face in opposing directions.

16. The antenna apparatus of claim 14, wherein:

the antenna apparatus is operable in a chosen mode which is one of a relay mode, a point-to-point mode, a point-to-multipoint mode and any combination thereof; and the chosen deployment configuration is chosen in dependence on the chosen mode.

17. The antenna apparatus of claim 1, wherein the plurality of antenna arrays are configured to operate using the same frequency channel or different frequency channels.

18. An antenna apparatus, comprising:

a plurality of antenna array means for producing a beam to facilitate wireless communication with at least one other antenna apparatus, each antenna array means having an associated antenna array plane;

beamforming means for electronically steering, for each antenna array means, the beam in an associated beamforming plane;

rotation means for rotating each antenna array means in its antenna array plane so as to cause the associated beamforming plane to rotate;

mounting plate means for supporting the plurality of antenna array means;

mounting plate rotation means for rotating the mounting plate means about a first axis; and further rotation means configured to rotate the plurality of antenna array means about a second axis perpendicular to the first axis.

* * * * *